US012710036B2

(12) United States Patent
Kay et al.

(10) Patent No.: US 12,710,036 B2
(45) Date of Patent: Aug. 18, 2026

(54) FLUID END WITH TRANSITION SURFACE GEOMETRY

(71) Applicant: GD Energy Products, LLC, Tulsa, OK (US)

(72) Inventors: Konner Casey Kay, Broken Arrow, OK (US); Paul Douglas Cary, Sapulpa, OK (US); Vadim Kachkovskiy, Spring Mills, PA (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 182 days.

(21) Appl. No.: 18/326,312

(22) Filed: May 31, 2023

(65) Prior Publication Data

US 2024/0401587 A1 Dec. 5, 2024

Related U.S. Application Data

(63) Continuation-in-part of application No. 17/972,717, filed on Oct. 25, 2022, now Pat. No. 12,590,578.

(51) Int. Cl.
*F04B 53/16* (2006.01)
*F04B 53/00* (2006.01)

(52) U.S. Cl.
CPC ..... *F04B 53/16* (2013.01); *F04B 53/007* (2013.01)

(58) Field of Classification Search
None
See application file for complete search history.

(56) References Cited

U.S. PATENT DOCUMENTS 2,325,672 A * 8/1943 Groff ..... F04B 53/144 417/570
2,816,515 A * 12/1957 Senkowski ..... F04B 9/045 184/6
5,701,872 A * 12/1997 Kaku ..... F04B 1/02 123/495
6,382,940 B1 5/2002 Blume
(Continued)

FOREIGN PATENT DOCUMENTS

CA 2949708 A1 11/2015
CN 106286181 A 1/2017

OTHER PUBLICATIONS

Definition of Smooth (obtained from https://www.merriam-webster.com/dictionary/smooth Dec. 12, 2024) (Year: 2024).*
(Continued)

*Primary Examiner* — Dominick L Plakkoottam
*Assistant Examiner* — Geoffrey S Lee
(74) *Attorney, Agent, or Firm* — Edell, Shapiro & Finnan, LLC

(57) ABSTRACT

A fluid end of a reciprocating pump includes multiple bores formed therein, and adjacent bores intersect each other. The intersection of two adjacent bores forms an intersection corner, which is where a concentration of high stress occurs during operation of the pump. A novel geometrical shape or geometry of the intersection corner reduces the concentration of stress on the intersection corners. By improving the shape and geometry of the intersection corner, the impact and concentration of the stress can be reduced, thereby improving or lengthening the lifetime of the material in that intersection corner of the fluid end.

20 Claims, 16 Drawing Sheets

(56) References Cited

U.S. PATENT DOCUMENTS 6,544,012 B1 * 4/2003 Blume ..... F04B 53/164 417/454
6,623,259 B1 9/2003 Blume
6,910,871 B1 * 6/2005 Blume ..... F04B 53/007 417/454
7,186,097 B1 * 3/2007 Blume ..... F04B 53/1032 417/454
7,513,759 B1 4/2009 Blume
8,147,227 B1 * 4/2012 Blume ..... F04B 53/164 137/512
8,348,644 B2 * 1/2013 Tsutsumidani ..... F04B 1/143 417/571
8,784,081 B1 * 7/2014 Blume ..... F04B 53/22 417/559
8,894,392 B1 * 11/2014 Blume ..... F04B 53/16 137/512
8,915,722 B1 12/2014 Blume
9,188,121 B1 11/2015 Dille
9,297,375 B1 * 3/2016 Dille ..... F04B 53/16
9,383,015 B2 7/2016 Cary
9,416,887 B2 8/2016 Blume
9,435,454 B2 9/2016 Blume
9,732,746 B2 8/2017 Chandrasekaran et al.
10,273,954 B2 4/2019 Brown et al.
10,302,078 B2 5/2019 Hiller
10,337,508 B2 7/2019 Cary et al.
10,731,643 B2 8/2020 DeLeon, II
10,907,632 B2 2/2021 Morreale et al.
11,346,340 B2 5/2022 Deleon, II
2005/0200081 A1 * 9/2005 Stanton ..... F16J 15/183 277/510
2008/0282879 A1 * 11/2008 Arnold ..... F04B 53/16 417/559
2012/0288387 A1 * 11/2012 Freed ..... F04B 53/16 417/454
2014/0345452 A1 * 11/2014 Cary ..... F16L 41/03 92/169.1
2017/0146011 A1 * 5/2017 Hiller ..... F04B 53/14
2017/0159655 A1 * 6/2017 Morreale ..... F16K 15/026
2017/0363082 A1 * 12/2017 Cary ..... F04B 53/10
2019/0072089 A1 3/2019 Buckley
2019/0154033 A1 * 5/2019 Brooks ..... F16K 15/026
2019/0242373 A1 * 8/2019 Wernig ..... F04B 1/0404
2019/0247957 A1 * 8/2019 Stribling ..... B24C 1/10
2019/0309858 A1 * 10/2019 Nowell ..... F04B 1/0452
2020/0355182 A1 * 11/2020 DeLeon, II ..... F04B 15/04
2023/0167817 A1 * 6/2023 Hurst ..... F04B 15/02 417/454
2023/0407852 A1 * 12/2023 Avey ..... F04B 17/00
2024/0401587 A1 * 12/2024 Kay ..... F04B 53/007

OTHER PUBLICATIONS

Definition of Radius (obtained from https://www.merriam-webster.com/dictionary/radius Dec. 18, 2024) (Year: 2024).*
Definition of Similar (obtained from https://dictionary.cambridge.org/us/dictionary/english/similar Dec. 16, 2024) (Year: 2024).*
Article on Steinmetz Solid (obtained from https://en.wikipedia.org/w/index.php?title=Steinmetz_solid Dec. 17, 2024) (Year: 2024).*

* cited by examiner

FLUID END WITH TRANSITION SURFACE GEOMETRY

RELATED APPLICATION

This patent application claims priority to and is a continuation-in-part of U.S. patent application Ser. No. 17/972,717, entitled "Fluid End with Transition Surface Geometry," filed Oct. 25, 2022, the entire disclosure of which is incorporated by reference in its entirety.

FIELD OF INVENTION

The present invention relates to the field of high pressure reciprocating pumps and, in particular, to fluid ends of high pressure reciprocating pumps and the surfaces between intersecting bores in the fluid ends.

BACKGROUND

High pressure reciprocating pumps are often used to deliver high pressure fluids during earth drilling operations. A reciprocating pump includes a fluid end that defines several different internal bores, adjacent ones of which intersect. In fluid ends with intersecting bores, the corners at which the bores intersect are typically stress concentration points. High stresses are due to the internal pressure in the pump and the fluid that is being pumped. The concentration of stress on the intersection corners negatively impacts the fatigue life of a pump fluid end and the quality of the finished fluid end housing or casing. It is typical practice to hand grind in a transitional radius at an intersecting corner to try to reduce the stress at the corner.

In fluid ends with intersecting bores, an intersecting corner is formed that is not uniform. As a result, a person must hand finish the corner in a radiused shape to soften the transition from one bore to the adjacent bore. The hand finished radius introduces a significant amount of irregularity from fluid end to fluid end, and is also physically demanding on the hand finisher. In addition, the hand finishing process increases the cost and time to manufacture and machine fluid ends.

To lengthen the lifetime of the fluid end of a reciprocating pump, there is a need to improve the corners of intersecting bores in the fluid end, and to improve the process by which the intersecting corners are manufactured.

SUMMARY

The present invention relates to a fluid end of a reciprocating pump that includes a housing defining multiple bores extending therein. Transition surfaces or areas are formed between intersecting bores in the fluid end. The present invention relates a machinable transition feature that overlaps both of the intersecting bores to soften the transition between intersecting bores, thereby minimizing the amount of hand finishing required in between intersecting bores.

The present invention improves the fatigue life of fluid ends of reciprocating pumps and improves the quality of the finished fluid end block, and does not add significant cost into the machining of the fluid end or negatively impact the serviceability of the fluid end. In addition, the new geometry is superior to the currently available hand finishing practice because it exchanges human activity for some additional machine time, thereby improving the consistency of the finished products.

The present invention also relates to a fluid end of a reciprocating pump that includes a housing defining a first bore and a second bore that intersects with the first bore. The first bore has a first inner surface that transitions from a first portion with a first inner diameter to a second portion with a second inner diameter, the second inner diameter being larger than the first inner diameter. The second bore has a second inner surface that transitions from a third portion with a third inner diameter to a fourth portion with a fourth inner diameter, the fourth inner diameter being larger than the third inner diameter. The second bore intersects with the first bore at a first intersection corner, wherein the first intersection corner defines a first transition area having a first transition surface where the second portion of the first inner surface and the fourth portion of the second inner surface intersect to form a slightly raised feature. The first transition surface is a machinable transition feature that overlaps both of the first bore and the second bore.

Still further, the present invention relates to a fluid end of a reciprocating pump, the fluid end including a housing defining a first bore and a second bore. The first bore has an inner surface defined by a first radius. The second bore is oriented substantially perpendicularly relative to the first bore, and has its own inner surface defined by a second radius different from the first radius. The second bore intersects with the first bore at a first intersection corner located in a cross-bore area of the housing, wherein the first intersection corner defines a first transition area having a first transition surface that is a machinable transition feature that overlaps both of the first bore and the second bore. The inner surfaces of the first bore and the second bore converge with each other at a convex point at the first transition area.

Still further, in some aspects, the present invention relates to a method of manufacturing a fluid end of a reciprocating pump, the fluid end including a housing. The method includes machining a first bore in the housing, the first bore having a first inner surface that transitions from a first portion with a first inner diameter to a second portion with a second inner diameter, the second inner diameter being larger than the first inner diameter. The method also includes machining a second bore in the housing, the second bore having a second inner surface that transitions from a third portion with a third inner diameter to a fourth portion with a fourth inner diameter, the fourth inner diameter being larger than the third inner diameter. The fourth portion of the second inner surface also intersects with the second portion of the first inner surface at a first intersection corner and collectively forming a slightly raised feature. The slightly raised feature can be hand finished by accessing the first intersection corner through a bore of the fluid end.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a fluid end of a reciprocating pump. Each of the different embodiments of fluid ends presented herein have multiple bores formed therein, and adjacent bores intersect each other. The intersection of two adjacent bores forms an intersection corner, which is where a concentration of high stress occurs during operation of the pump. The particular shape and geometry of the intersection corner determines the impact of the stress and the level of concentration of stress on the intersection corner. By improving the shape and geometry of the intersection corner, the impact and concentration of the stress can be reduced, thereby improving or lengthening the lifetime of the material in that intersection corner of the fluid end.

In this invention, a novel geometry approach is used to reduce the stress at one or more of the intersection corners. In one embodiment, a fluid end of a reciprocating pump includes a housing defining multiple bores extending therein. Transition surfaces or areas are formed between intersecting bores in the fluid end. A machinable transition feature overlaps both bores of a set or pair of intersecting bores to soften the transition between them, thereby minimizing the amount of hand finishing required in between intersecting bores.

The fatigue life of fluid ends of reciprocating pumps is improved as well as the quality of the finished fluid end block. The present invention does not add significant cost into the machining of the fluid end or negatively impact the serviceability of the fluid end. The new geometry is superior to the currently available hand finishing practice because it uses less human activity (hand finishing) and more machining time, thereby improving the consistency of the finished products.

Figure 1:
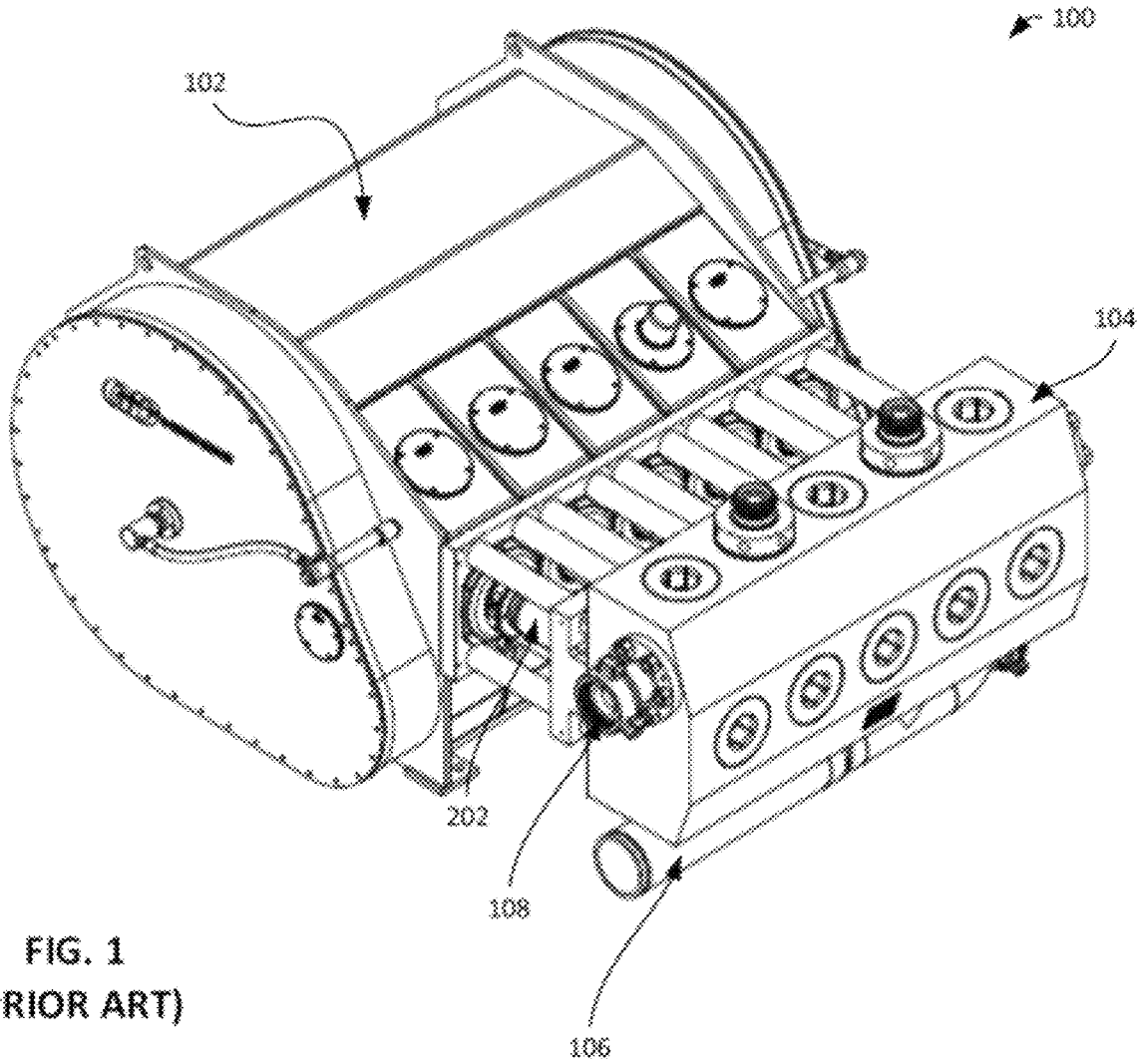
FIG. 1 (PRIOR ART)
FIG. 1 is a perspective view of a prior art reciprocating pump including a fluid end.

Referring to FIG. 1, a prior art reciprocating pump 100 is illustrated. The reciprocating pump 100 includes a power end 102 and a fluid end 104. The power end 102 includes a crankshaft that drives a plurality of reciprocating plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

Often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, especially typical "wear" components, and extend the time between maintenance operations (i.e., between downtime) are highly desirable.

Figure 2:
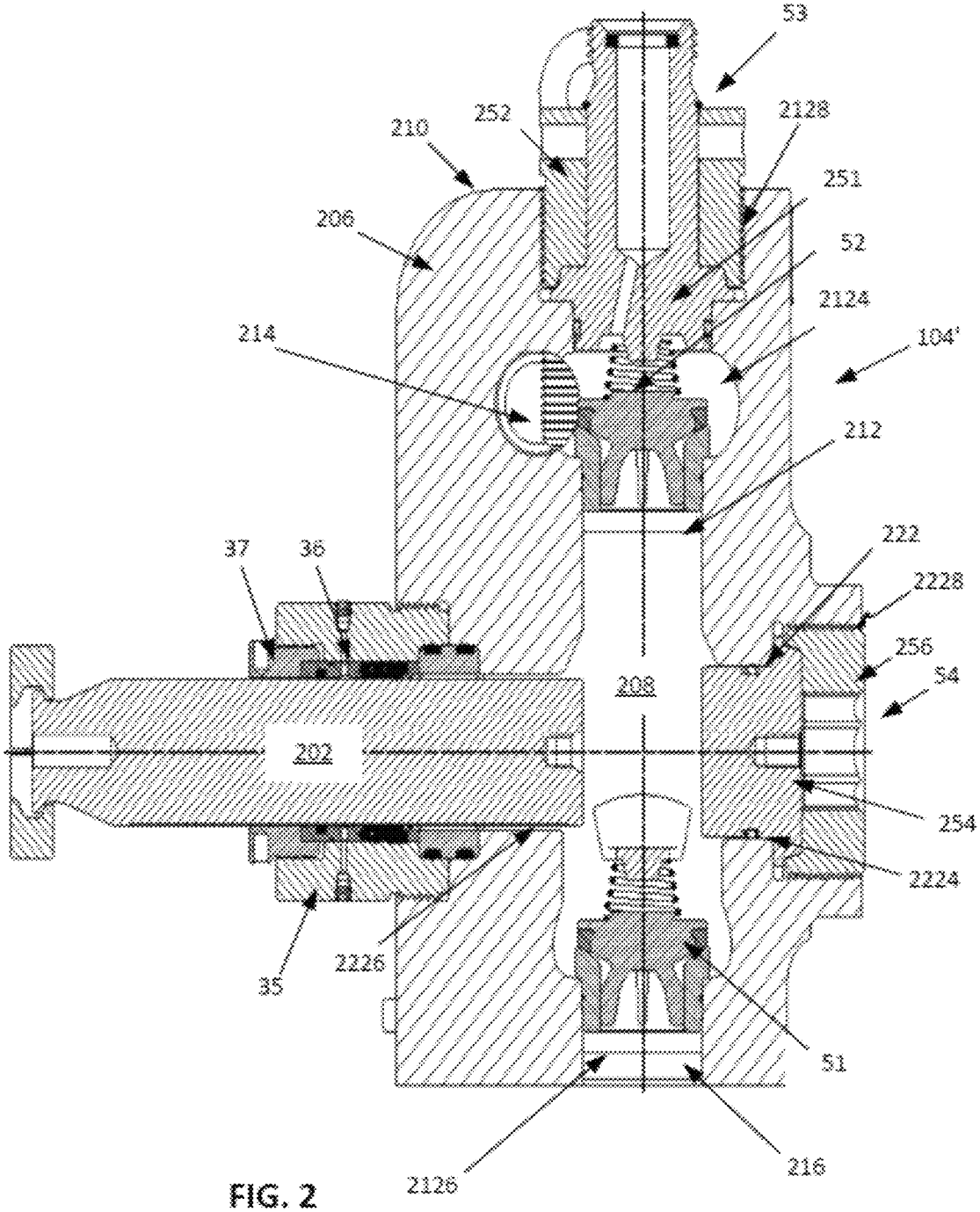
FIG. 2 (PRIOR ART)
FIG. 2 is a side cross-sectional view of a fluid end of another prior art reciprocating pump.

Still referring to FIG. 1, but now in combination with FIG. 2, in various embodiments, the fluid end 104 may be shaped differently and/or have different features, but may still generally perform the same functions, define similar structures, and house similar components. To illustrate potential shape variations, FIG. 2 shows a side, cross-sectional view of a fluid end 104' with different internal and external shaping as compared to fluid end 104. However, since fluid end 104 and fluid end 104' have many operational similarities, FIGS. 1 and 2 are labeled with the same reference numerals and are both described with respect to these common reference labels.

The cross-sectional view of FIG. 2 is taken along a central or plunger axis of one of the plungers 202 included in reciprocating pump 100. Thus, although FIG. 2 depicts a single pumping chamber 208, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208 and each chamber 208 includes a plunger 202 that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the plunger 202, low pressure fluid is drawn into the pumping chamber 208 and high pressure fluid is discharged. But, often, the fluid within the pumping chamber 208 contains abrasive material (i.e., "debris") that can damage seals formed in the reciprocating pump 100.

As can be seen in FIG. 2, the pumping paths and pumping chamber 208 of the fluid end 104' are formed by conduits that extend through the casing 206 to define openings at an external surface 210 of the casing 206. More specifically, a first conduit 212 extends longitudinally (e.g., vertically) through the casing 206 while a second conduit 222 extends laterally (e.g., horizontally) through the casing 206. Thus, conduit 212 intersects conduit 222 to at least partially (and collectively) define the pumping chamber 208. In the prior art fluid end 104 and prior art fluid end 104', conduits 212 and 222 are substantially cylindrical, but the diameters of conduit 212 and conduit 222 may vary throughout the casing 206 so that conduits 212 and 222 can receive various structures, such as sealing assemblies or components thereof.

Regardless of the diameters of conduit 212 and conduit 222, each conduit may include two segments, each of which extends from the pumping chamber 208 to the external surface 210 of the casing 206 and may also be referred to as a bore. Specifically, conduit 212 includes a first segment 2124 and a second segment 2126 that opposes the first segment 2124. Likewise, conduit 222 includes a third segment 2224 and a fourth segment 2226 that opposes the third segment 2224. In the illustrated embodiment, the segments of a conduit (e.g., segments 2124 and 2126 or segments 2224 and 2226) are substantially coaxial while the segments of different conduits are substantially orthogonal. However, in other embodiments, segments 2124, 2126, 2224, and 2226 may be arranged along any desired angle or angles, for example, to intersect pumping chamber 208 at one or more non-straight angles.

In this embodiment, conduit 212 defines a fluid path through the fluid end 104. Segment 2126 is an intake segment that connects the pumping chamber to a piping system 106 delivering fluid to the fluid end 104. Meanwhile, segment 2124 is an outlet or discharge segment that allows compressed fluid to exit the fluid end 104. Thus, in operation, segments 2126 and 2124 may include valve components 51 and 52, respectively, (e.g., one-way valves) that allow segments 2126 and 2124 to selectively open. Typically, valve components 51 in the inlet segment 2126 may be secured therein by a piping system 106 (see FIG. 1). Meanwhile valve components 52 in outlet segment 2124 may be secured therein by a closure assembly 53 that, in the prior art example illustrated in FIG. 2, includes a closure element 251 (also referred to as a discharge plug) that is secured in the segment 2124 by a retaining assembly 252. Notably, the prior art retaining assembly 252 is coupled to segment 2124 via threads 2128 defined by an interior wall of segment 2124.

On the other hand, segment 2226 defines, at least in part, a cylinder for plunger 202, and/or connects the casing 206 to a cylinder for plunger 202. For example, in the illustrated embodiment, a casing segment 35 is secured to segment 2226 and houses a packing assembly 36 configured to seal against a plunger 202 disposed interiorly of the packing assembly 36. In any case, reciprocation of a plunger 202 in or adjacent to segment 2226, which may be referred to as a reciprocation segment, draws fluid into the pumping chamber 208 via inlet segment 2126 and pumps the fluid out of the pumping chamber 208 via outlet segment 2124. Notably, in the illustrated prior art arrangement, the packing assembly 36 is retained within casing segment 35 with a retaining element 37 that is threadedly coupled to casing segment 35.

Segment 2224 is an access segment that can be opened to access to parts disposed within casing 206 and/or surfaces defined within casing 206. During operation, access segment 2224 may be closed by a closure assembly 54 that, in the prior art example illustrated in FIG. 2, includes a closure element 254 (also referred to as a suction plug) that is secured in the segment 2224 by a retaining assembly 256. Notably, the prior art retaining assembly 256 is coupled to segment 2224 via threads 2228 defined by an interior wall of segment 2224. However, in some embodiments, conduit 222 need not include segment 2224 and conduit 222 may be formed from a single segment (segment 2226) that extends from the pumping chamber 208 to the external surface 210 of casing 206.

Overall, in operation, fluid may enter fluid end 104 (or fluid end 104') via multiple openings, as represented by opening 216 in FIG. 2, and exit fluid end 104 (or fluid end 104') via multiple openings, as represented by opening 214 in FIG. 2. In at least some embodiments, fluid enters openings 216 via pipes of piping system 106, flows through pumping chamber 208 (due to reciprocation of a plunger 202), and then flows through openings 214 into a channel 108. However, piping system 106 and channel 108 are merely example conduits and, in various embodiments, fluid end 104 may receive and discharge fluid via any number of pipes and/or conduits, along pathways of any desirable size or shape.

Also, during operation of pump 100, the first segment 2124 (of conduit 212), the third segment 2224 (of conduit 222), and the fourth segment 2226 (of conduit 222) may each be "closed" segments. By comparison, the second segment 2126 (of conduit 212) may be an "open" segment that allows fluid to flow from the external surface 210 to the pumping chamber 208. That is, for the purposes of this application, a "closed" segment may prevent, or at least substantially prevent, direct fluid flow between the pumping chamber 208 and the external surface 210 of the casing 206 while an "open" segment may allow fluid flow between the pumping chamber 208 and the external surface 210. To be clear, "direct fluid flow" requires flow along only the segment so that, for example, fluid flowing from pumping chamber 208 to the external surface 210 along segment 2124 and channel 108 does not flow directly to the external surface 210 via segment 2124.

Figure 3:
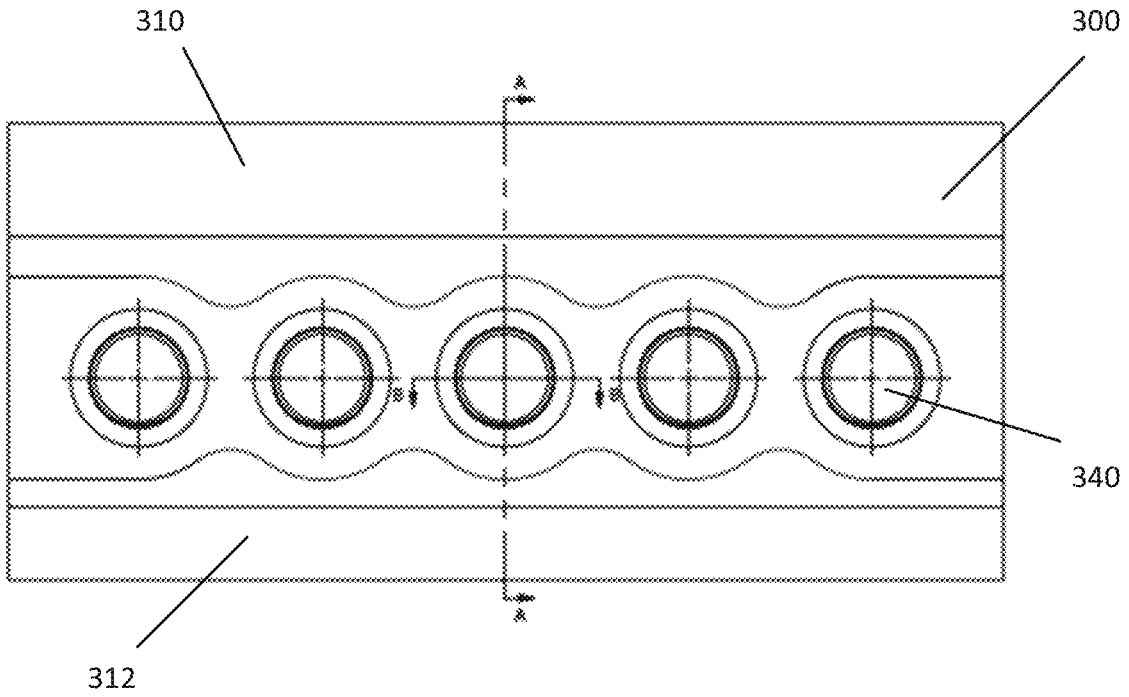
FIG. 3 is a plan view of an embodiment of a fluid end of a reciprocating pump according to the present invention looking into the access bores of the fluid end.
Figure 4:
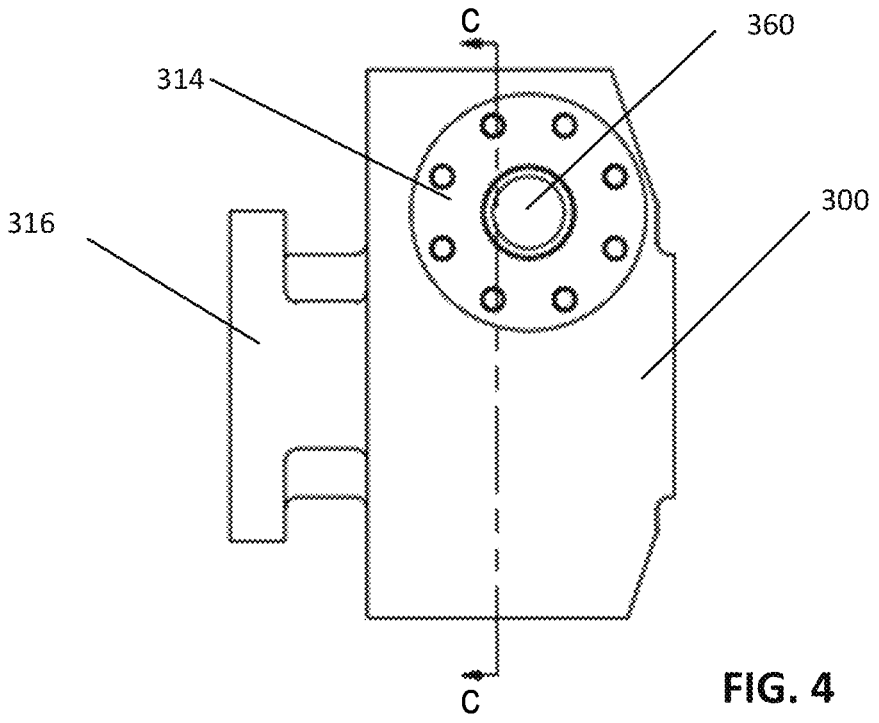
FIG. 4 is an end view of the fluid end illustrated in FIG. 3.

Now turning to FIGS. 3 and 4, plan and side or end views of an exemplary embodiment of a fluid end according to the present application are illustrated, respectively. In this embodiment, fluid end 300 includes a casing or housing 310 that has an outer surface 312. As shown in FIG. 3, the fluid end 300 has several access bores 340 that are aligned with corresponding plunger bores. It can be appreciated that the fluid end 300 may include any number of access bores 340 in different embodiments, and should not be limited to only five access bores 340 as illustrated in FIG. 3. Additionally or alternatively, the outer surface 312 of the fluid end casing 310 can have any number of shapes or features, as mentioned above in connection with the prior art of FIGS. 1 and 2. For example, in other embodiments, the outer surface 312 of the fluid end casing 310 might be flangeless. As shown in the side view illustrated in FIG. 4, the fluid end 300 includes an inlet end 314 and a power end 316. The inlet end 314 defines an inlet bore 360. Examples of pump fluid ends are disclosed in U.S. Pat. Nos. 9,383,015 and 10,337,508, the disclosures of each of which are incorporated by reference herein in their entirety.

Figure 5:
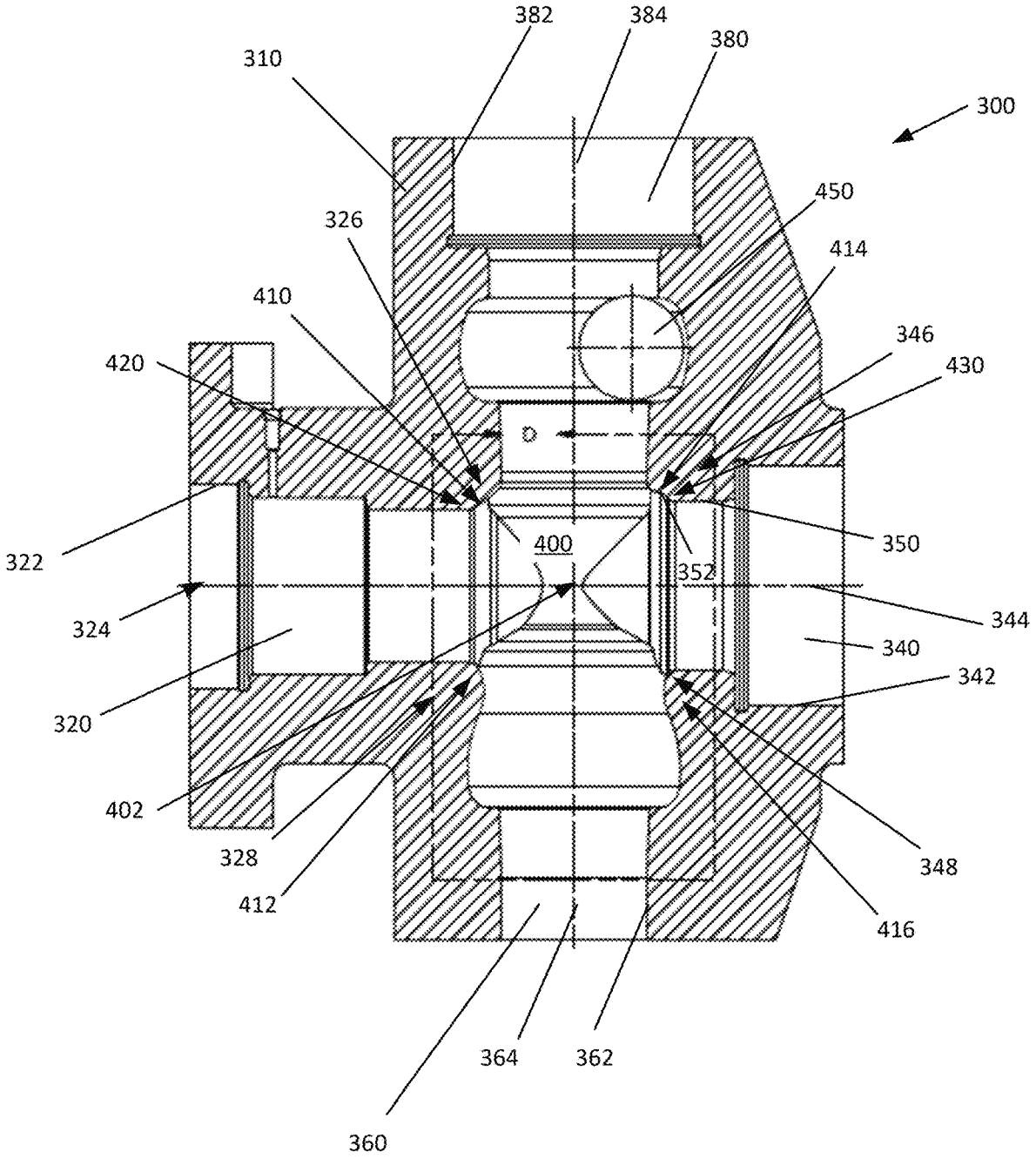
FIG. 5 is a side cross-sectional view of the fluid end illustrated in FIG. 3 taken along line "A-A".
Figure 6:
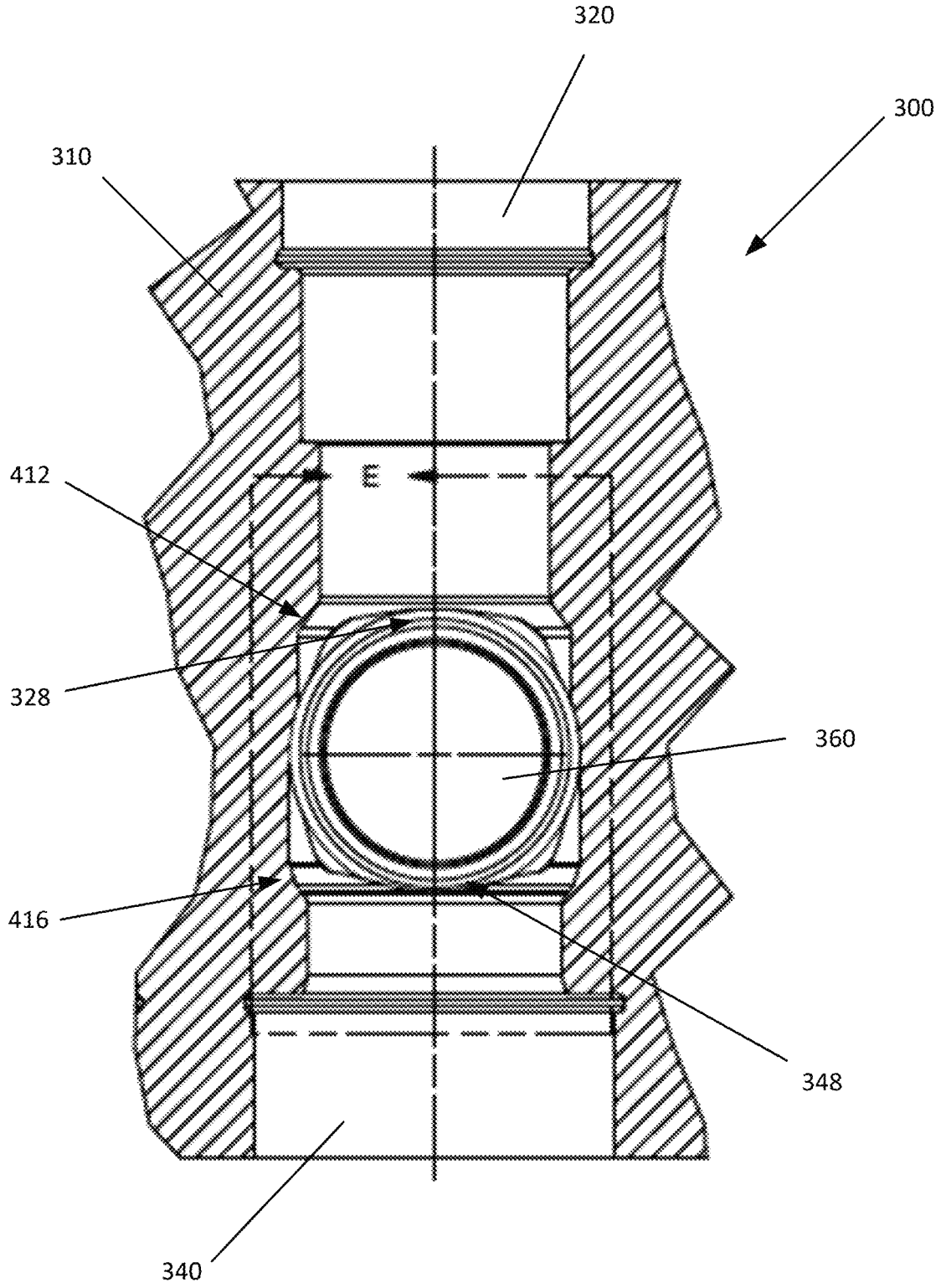
FIG. 6 is a top cross-sectional view of the fluid end illustrated in FIG. 3 taken along line "B-B".
Figure 7:
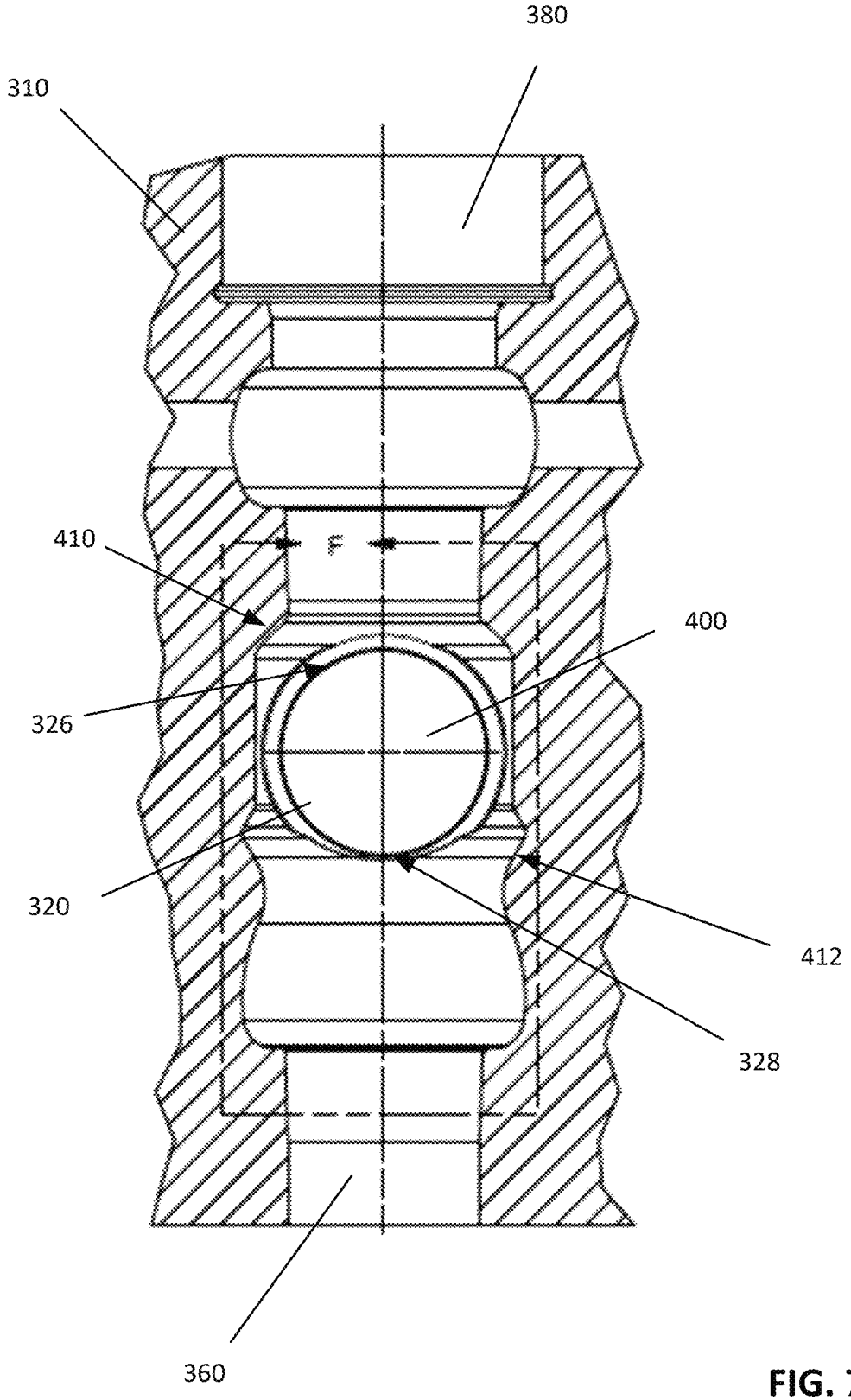
FIG. 7 is a plan cross-sectional view of the fluid end illustrated in FIG. 4 taken along line "C-C".

Each of FIGS. 3 and 4 includes one or more cross-sectional lines that define the views illustrated in subsequent FIGS. Line "A-A" defines the side cross-sectional view illustrated in FIG. 5, line "B-B" defines the top cross-sectional view illustrated in FIG. 6, and line "C-C" defines the plan cross-sectional view illustrated in FIG. 7. Similar cross-sectional views for additional embodiments of pump fluid ends disclosed herein utilize similar cross-sectional lines to those shown in FIGS. 3 and 4.

Referring to FIG. 5, a side cross-sectional view of the fluid end 300 illustrated in FIG. 3 taken along line "A-A" is illustrated. In this view, the valve components and closure and retaining assemblies have been removed from the fluid end 300 to facilitate the description thereof. The casing or housing 310 of fluid end 300 includes a plunger or power end bore 320 that is a bore for a reciprocating member, such as a plunger. The plunger bore 320 has an inner wall 322 that defines the bore 320. The plunger bore 320 also has a plunger axis or centerline 324 that extends therethrough. The casing 310 includes a valve cover or access bore 340 which is defined by an inner surface 342 and has a centerline or axis 344. In this embodiment, valve cover bore 340 does not include a threaded region for the mounting of various fluid end components, but in other embodiments, threads may be formed on inner surface 342. In this embodiment, centerline 344 of bore 340 is aligned with centerline 324 of bore 320; but bores 320 and 340 need not always be aligned.

The fluid end casing 310 also includes an inlet bore 360 that is defined by an inner surface 362 and has a centerline or axis 364. The casing 310 also includes a discharge bore 380 that is defined by an inner surface 382 and has a centerline or axis 384. In this embodiment, the discharge bore 380 does not include a threaded region for the mounting of various fluid end components, but other embodiments, threads may be formed on inner surface 382. The discharge bore 380 is also in fluid communication with a fluid outlet 450. The centerline 364 of bore 360 is aligned with centerline 384 of bore 380, but, again, these bores need not always be aligned. The bores 320, 340, 360, and 380 of the casing 310 converge to a common intersection, referred to as a cross-bore or cross-bore intersection 400. The cross-bore intersection 400 (i.e., the pumping chamber) defines an open space in housing 310.

As illustrated in FIG. 5, between each pair of intersecting adjacent bores is an intersection corner that has a transition area that includes a surface. Bores 320 and 380 are adjacent to each other and intersect, thereby forming a corner or intersection or overlapping corner 326. Corner 326 includes a transition area 410 between the corners of bores 320 and 380. Similarly, bores 320 and 360 are adjacent to each other and intersect, thereby forming a corner or intersection corner 328. Corner 328 includes a transition area 412 between the corners of bores 320 and 360. Often, surfaces located at the intersection of adjacent bores in a fluid end casing experience a high concentration of stresses due to the internal pressure and the particular fluid being pumped. In this embodiment, intersection corners 326 and 328 with their respective transition areas 410 and 412 are locations at which the concentration of stresses is high during operation of the pump (i.e., the corners bordering plunger bore 320). Each of the intersection corners 326 and 328 has been machined so that it includes a machinable transition feature that overlaps both of the adjacent and intersecting bores that form the intersection corners 326 and 328. The term "overlapping" in the context of overlapping a bore means that the feature that has been machined extends into the bore, thereby resulting in a smooth transition from that bore into the relevant adjacent intersection corner(s).

Bores 340 and 380 are adjacent to each other and intersect, thereby forming a corner or intersection or overlapping corner 346. Corner 346 includes a transition area 414 between the corners of bores 340 and 380. Similarly, bores 340 and 360 are adjacent to each other and intersect, thereby forming a corner or intersection corner 348. Corner 348 includes a transition area 416 between the corners of bores 340 and 360. Intersection corners 346 and 348 are locations at which the concentration of stresses is high during operation of the pump (i.e., the corners bordering suction bore 340), just like intersection corners 326 and 328. Each of the intersection corners 346 and 348 has been machined so that it includes a machinable transition feature that overlaps both of the adjacent and intersecting bores that form the intersection corners 346 and 348. Each of the corners 326, 328, 346, and 348 can be referred to as an intersection corner.

To reduce the stresses on the surfaces inside of the fluid end casing, and in particular, on the intersection or overlapping corners between adjacent bores, the present invention relates to machined surfaces located in the transition areas between adjacent bores. If a plane was created using the center axis of the horizontal bores and the vertical bores, the profiles of the horizontal bores and the vertical bores intersect at substantially tangent points. For manufacturability, it is helpful for each intersection or intersecting point to be a slightly raised point relative to the surrounding surfaces, so the intersection point can be easily hand-finished or easily knocked down with a sanding tool. If an intersection point is sunken relative to the surrounding surfaces, it is challenging to soften the transition between the two intersecting bores. When two adjacent and intersecting surfaces are tangent, the angle between them is 180 degrees. The term "substantially tangent" as used herein encompasses adjacent surfaces that form an angle of 140 degrees or greater, up to 180 degrees, and more preferably, form an angle of 155 degrees or greater, up to 180 degrees.

In the illustrated embodiment, the intersection point falls on an intersection line that travels along the cross-bore intersection at all points where the vertical bores intersect with the horizontal bores. The intersection points are the locations that experience the highest stress for the cross-bore intersection. By providing a substantially tangent surface, the stress is reduced in those locations. As one moves along each intersecting bore transition line away from an intersection point (see FIG. 8), the intersection between the intersecting horizontal and vertical bores become "less tangent" where the stress in the cross-bore is lower.

In one embodiment, the upper transition surfaces 410 and 414 are formed in a similar manner to each other and the lower transition surfaces 412 and 416 are formed in a similar manner to each other, which is different than transition surfaces 410 and 414. In an alternative embodiment, as described below relative to FIGS. 11-18, the upper transition surfaces are formed in the same manner as the lower transition surfaces.

Returning to the embodiment illustrated in FIG. 5, each of the upper transition surfaces 410 and 414 is polished so that it is aligned with a hemisphere or partial sphere profile or portion in a manner consistent with that disclosed in U.S. patent application Ser. No. 17/972,717, entitled "Fluid End with Transition Surface Geometry," filed Oct. 25, 2022, the entire disclosure of which is incorporated by reference in its entirety. The surface of transition area 410 is formed to match the shape of the hemisphere portion. Similarly, the surface of transition area 414 is formed to match the shape of the same hemisphere portion. The hemisphere portion or profile overlaps the corners of adjacent bores 320 and 380 and the corners of adjacent bores 340 and 380. The surfaces of transition areas 410 and 414 form the transition surfaces between bore 380 and the cross-bore 400. The hemisphere portion has a center point 402 which is located at the intersection of the centerlines of adjacent bores. In particular, center point is located at the intersection of centerlines 324 and 384 and the intersection of centerlines 344 and 384. The hemisphere portion and transition areas 410 and 414 are located on the top side of the center-bore 400. In this embodiment, neither the surface of transition area 412 nor the surface of transition area 416 is formed to match the shape of a hemisphere portion. Each of those transition areas 412 and 416 has been formed into a substantially tangent point in profile, which is the result of a machining or hand finishing process that reduces any sharp edge.

FIG. 6 is a top cross-sectional view of the fluid end illustrated in FIG. 3 taken along line "B-B". In FIG. 6, the horizontal bores 320 and 340 are illustrated as being aligned with each other and intersecting with bore 360 at bore transition areas 328 and 348, which include transition areas 412 and 416, respectively. The transition areas 412 and 416 that are formed on opposite sides of bore 360 are shown. Transition area 412 is located between bores 320 and 360, and transition area 416 is located between bores 340 and 360.

In this embodiment, fluid end 300 includes transition features that are included in transition areas 410 and 414 (see FIG. 5). In particular, transition feature 420 is located in transition area 410 at the intersection of bore 320 and bore 380. Transition feature 420 is configured to reduce the stresses at the intersection of bores 320 and 380. Similarly, transition feature 430 is located in transition area 414 at the intersection of bore 340 and bore 380. Transition feature 430 is also configured to reduce the stresses at the intersection of bores 340 and 380.

During manufacturing of the fluid end 300, the hemisphere profile of certain surfaces is machined from only one of the two bores that intersect. The other bore has a transition feature, such as transition feature 420 or 430 shown in FIG. 5. Transition feature 430 is located in bore 340 where there are portions of bore 340 with different inner diameters. In particular, bore 340 has a first bore portion 350 with a first inner diameter and a second bore portion 352 with a second inner diameter different from the first inner diameter. In this embodiment, the second inner diameter is slightly larger than the first inner diameter. Transition feature 430 is located between the first bore portion 350 and the second bore portion 352, and is designed for a smoother transition between bore 340 and bore 380. While this discussion relates to transition feature 430, the same discussion applies to transition feature 420 and its relationship between bore 320 and bore 380.

Referring to FIG. 7, a plan cross-sectional view of the fluid end 320 illustrated in FIG. 4 taken along line "C-C" is illustrated. In this view, bores 360 and 380 are oriented vertically and plunger bore 320 is oriented horizontally. The intersection corner 326 is shown between bore 380 and 320. The surface of transition area 410 of intersection corner 326 is shaped along a hemisphere or partial sphere portion. In this embodiment, the intersection corner 326 is located on the top side of the cross-bore 400.

At the lower side of bore 320, the intersection corner 328 and transition area 412 are illustrated between bores 320 and 360. In this embodiment, the surface of transition area 412 of intersection corner 328 is not shaped along a hemisphere portion. The intersection corner 328 and transition area 412 have an intersecting geometry that is not hemispherical.

Figure 8:
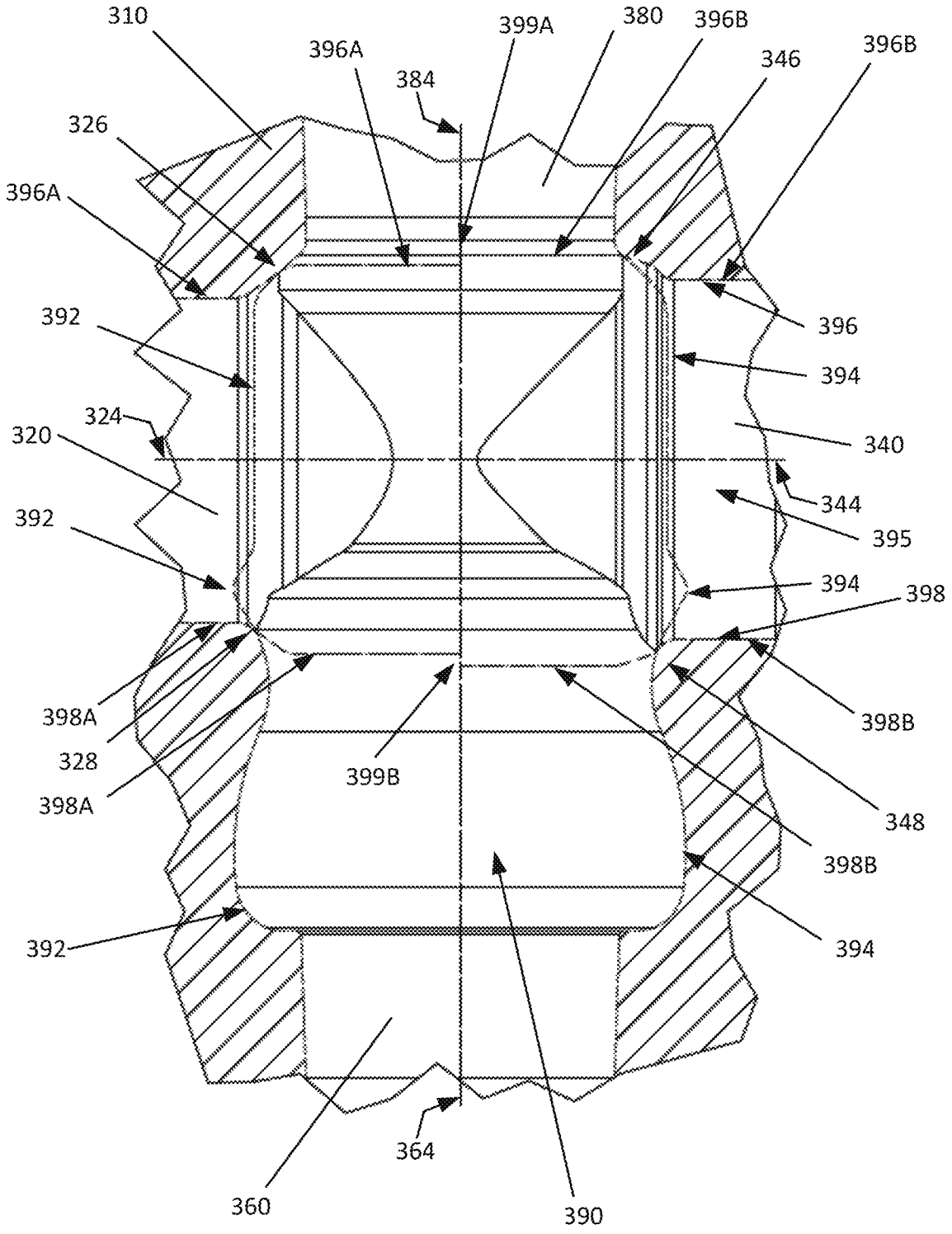
FIG. 8 is a close-up detailed view of the fluid end cross-sectional view illustrated in FIG. 5.

Turning to FIG. 8, a close-up detailed view of a portion of the fluid end casing 310 illustrated in FIG. 5 is shown. Inlet bore 360 and discharge bore 380 collectively define a vertical bore 390. Vertical bore 390 is shown in FIG. 8 by dashed line 392 and dashed line 394. In this embodiment, dashed line 392 follows the inner surfaces that form inlet bore 360 and the inner surfaces that form discharge bore 380. Dashed line 392 passes over and defines in part the intersection of plunger bore 320 and inlet bore 360, which is shown as bore intersection 328. In addition, dashed line 392 passes over and defines in part the intersection of plunger bore 320 and discharge bore 380, which is shown as bore intersection 326.

Dashed line 394 follows the inner surfaces that form inlet bore 360 and the inner surfaces that form discharge bore 380. Dashed line 394 passes over and defines in part the intersection of access bore 340 and inlet bore 360, which is shown as bore intersection 348. In addition, dashed line 394 passes over and defines in part the intersection of access bore 340 and discharge bore 380, which is shown as bore intersection 346.

Similarly, plunger bore 320 and access bore 340 collectively define a horizontal bore 395. Horizontal bore 395 is shown in FIG. 8 by dashed line 396 and dashed line 398. In this embodiment, the inner diameter of the plunger bore 320 is different than the inner diameter of the access bore 340. In particular, the inner diameter of the plunger bore 320 is smaller than the inner diameter of the access bore 340 (see also FIG. 6).

Dashed line 396 follows the inner surfaces that form plunger bore 320 and the inner surfaces that form access bore 340. However, due to the difference in inner diameters between the plunger bore 320 and the access bore 340, dashed line 396 includes two different portions, namely, line 396A and line 396B as shown in FIG. 8. Dashed line 396A follows the inner surface of the plunger bore 320 and passes over and defines in part the intersection of plunger bore 320 and discharge bore 380, which is shown as bore intersection 326. Dashed line 396B follows the inner surface of the access bore 340 and passes over and defines in part the intersection of access bore 340 and discharge bore 380, which is shown as bore intersection 346. Dashed lines 396A and 396B are offset from each other and terminate at the centerline 384 of discharge bore 380 at area 399A.

Dashed line 398 follows the inner surfaces that form plunger bore 320 and the inner surfaces that form access bore 340. The difference in inner diameters between the plunger bore 320 and the access bore 340 results in dashed line 398 having two different portions as well, namely, line 398A and line 398B (see FIG. 8). Dashed line 398A follows the inner surface of the plunger bore 320 and passes over and defines in part the intersection of plunger bore 320 and inlet bore 360, which is shown as bore intersection 328. Dashed line 398B follows the inner surface of the access bore 340 and passes over and defines in part the intersection of access bore 340 and inlet bore 360, which is shown as bore intersection 348. Dashed lines 398A and 398B area offset from each other and terminate at the centerline 364 of inlet bore 360 at area 399B.

In this embodiment, the horizontal bore 395 and the horizontal transition features that are located at transition areas 326, 328, 346, and 348 are created using radii that transition into coned surfaces. The horizontal bore 395, as indicated by dashed lines 396 and 398, intersects each section of the vertical bore 390, as indicated by dashed lines 392 and 394, at different convex and concave radii.

As mentioned above, the upper bore intersections illustrated in FIG. 8, namely, bore intersection 326 and bore intersection 346, are formed so that each of them engages and intersects a hemisphere or partial sphere profile. As shown in FIG. 8, the shape of bore intersection 326 is generally the same as the shape of bore intersection 346. However, due to the difference in the inner diameters of the plunger bore 320 and the access bore 340, the locations and exact shape of the surfaces of the bore intersections 326 and 346 are different. In this embodiment, the surface of bore intersection 326 matches or engages a first hemisphere profile that has a different radius than a second hemisphere profile that is matched or engaged by the surface of bore intersection 346. In this example, the radius of the second hemisphere profile is greater than the radius of the first hemisphere profile because the diameter of the access bore 340 is greater than the diameter of the plunger bore 320.

The lower bore intersections 328 and 348 do not include a hemisphere in their intersecting geometry. As shown in FIG. 8, the profile of the lower bore intersections 328 and 348 are different than the upper bore intersections 326 and 346. Each of the lower bore intersections 328 and 348 are formed with a point or extended portion that can be reduced down during manufacturing so that each of the bore intersections or intersection corners 328 and 348 has been formed into a substantially tangent point in profile. The intersection of vertical bore line 392 and horizontal bore line 398A forms a point at bore intersection 328. Similarly, the intersection of vertical bore line 394 and horizontal bore line 398B forms a point at bore intersection 348.

As shown in FIG. 8, the plunger bore 320 and the access bore 340 collectively form a horizontal bore, and that horizontal bore intersects each of the inlet bore 360 and the discharge bore 380 at a surface with a radius that is different that the horizontal bore's intersection with the other of the inlet bore 360 and the discharge bore 380. In some intersection corners, the intersection has a convex radius (such as bore intersections 328 and 348). In other intersection corners, the intersection has a concave radius (such as bore intersections 326 and 346).

Figure 9:
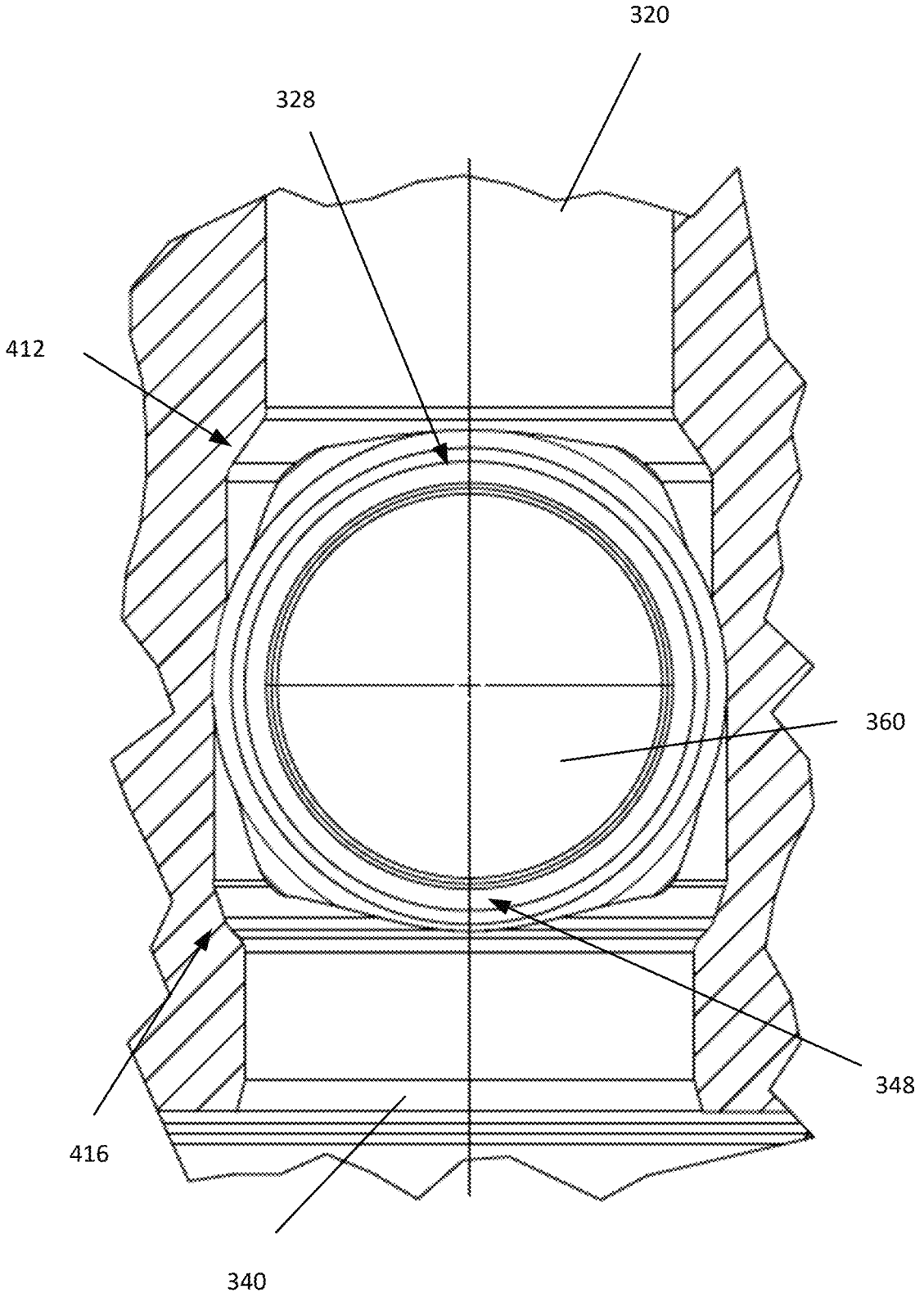
FIG. 9 is a close-up detailed view of the fluid end cross-sectional view illustrated in FIG. 6.

Referring to FIG. 9, a close-up detailed view of the fluid end cross-sectional view illustrated in FIG. 6 is shown. The bore intersection 328 has a similar structure to bore intersection 348 because both of them are on the bottom portion of the horizontal bore 395.

Figure 10:
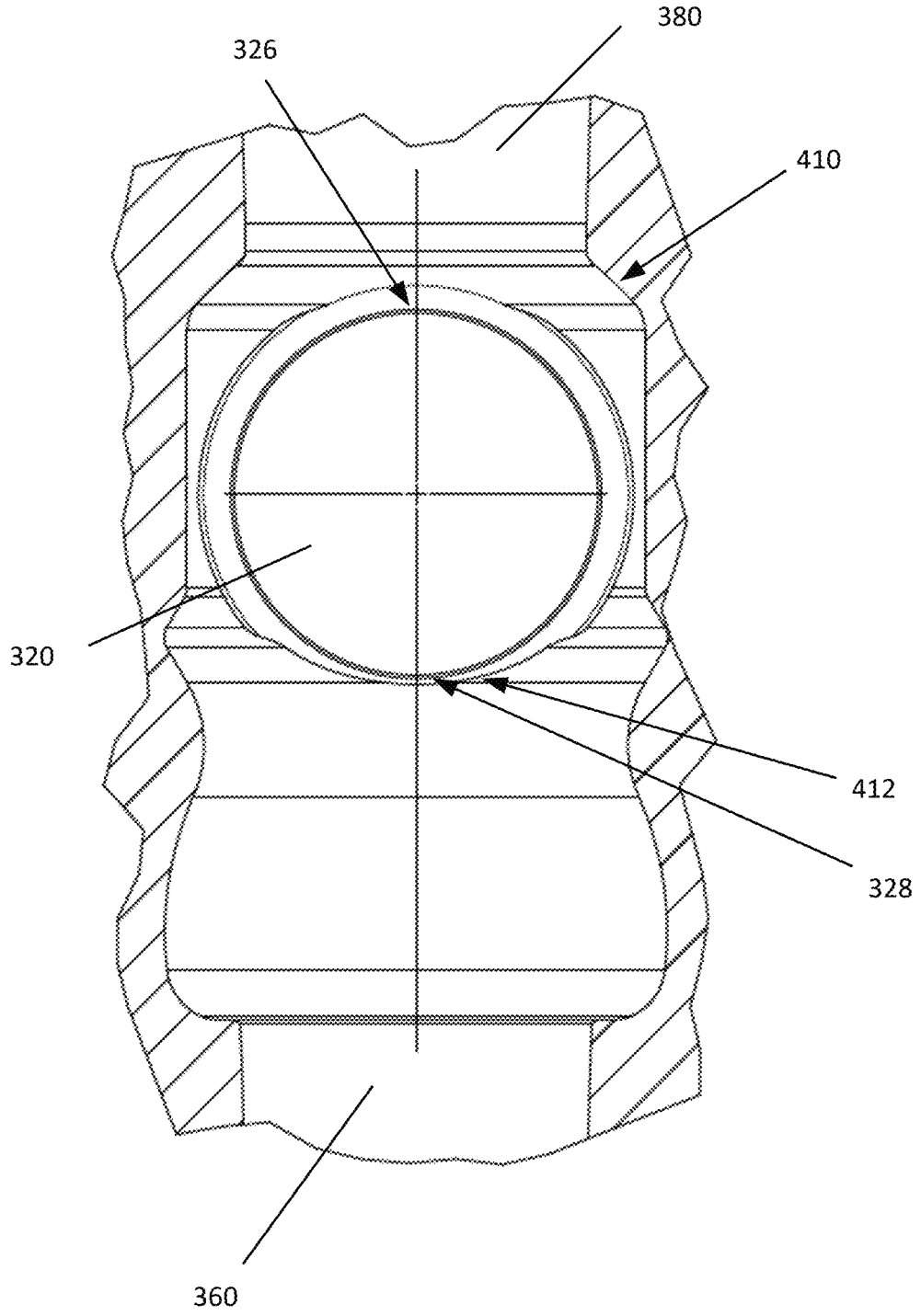
FIG. 10 is a close-up detailed view of the fluid end cross-sectional view illustrated in FIG. 7.

Similarly, referring to FIG. 10, a close-up detailed view of the fluid end cross-sectional view illustrated in FIG. 7 is shown. The bore intersection 326 and its transition area 410 are located on the upper side or portion of the horizontal bore 395, which is aligned with plunger bore 320 in FIG. 10. The bore intersection 328 and its transition area 412 are located on the lower side or portion of the horizontal bore 395. As shown in FIG. 10, bore intersection 326 and bore intersection 328 are different from each other, which is the result of bore intersection 326 being formed to engage a hemisphere or partial sphere portion, and bore intersection 328 being formed to be a point.

Figure 11:
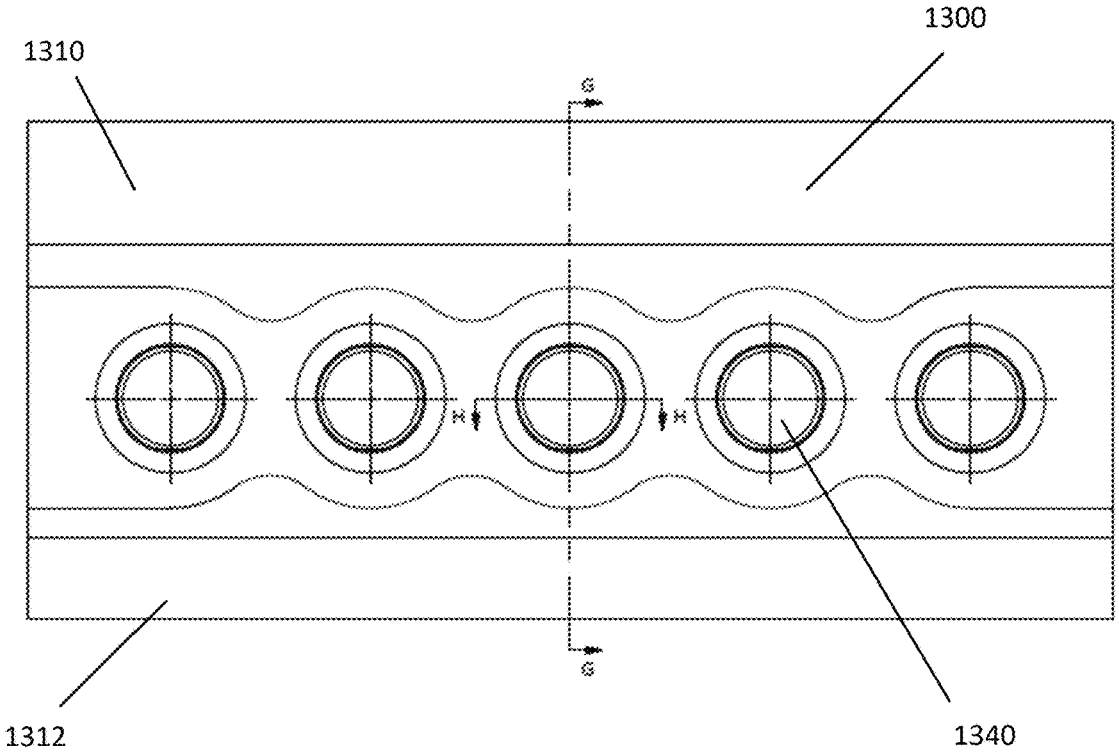
FIG. 11 is a plan view of an alternative embodiment of a fluid end of a reciprocating pump according to the present invention looking into the access bores of the fluid end.
Figure 12:
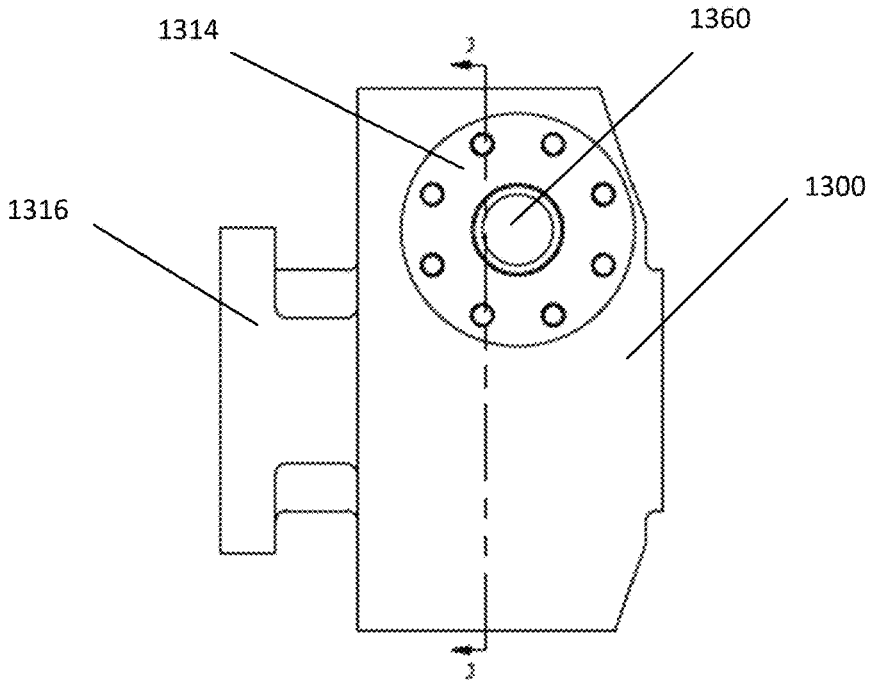
FIG. 12 is an end view of the fluid end illustrated in FIG. 11.

Now turning to FIGS. 11 and 12, plan and side views of an alternative embodiment of a fluid end according to the present application are illustrated. In this embodiment, fluid end 1300 includes a casing or housing 1310 that has an outer surface 1312. As shown in FIG. 11, the fluid end 1300 has several access bores 1340 that are aligned with corresponding plunger bores. It can be appreciated that the fluid end 1300 may include any number of access bores 1340 in different embodiments, and should not be limited to only five access bores 1340 as illustrated in FIG. 11. Additionally or alternatively, the outer surface 1312 of the fluid end casing 1310 can have any number of shapes or features, as mentioned above in connection with the prior art of FIGS. 1 and 2. For example, in other embodiments, the outer surface 1312 of the fluid end casing 1310 might be flangeless. As shown in the side view illustrated in FIG. 12, the fluid end 1300 includes an inlet end 1314 and a power end 1316. The inlet end 1314 defines an inlet bore 1360.

Figure 13:
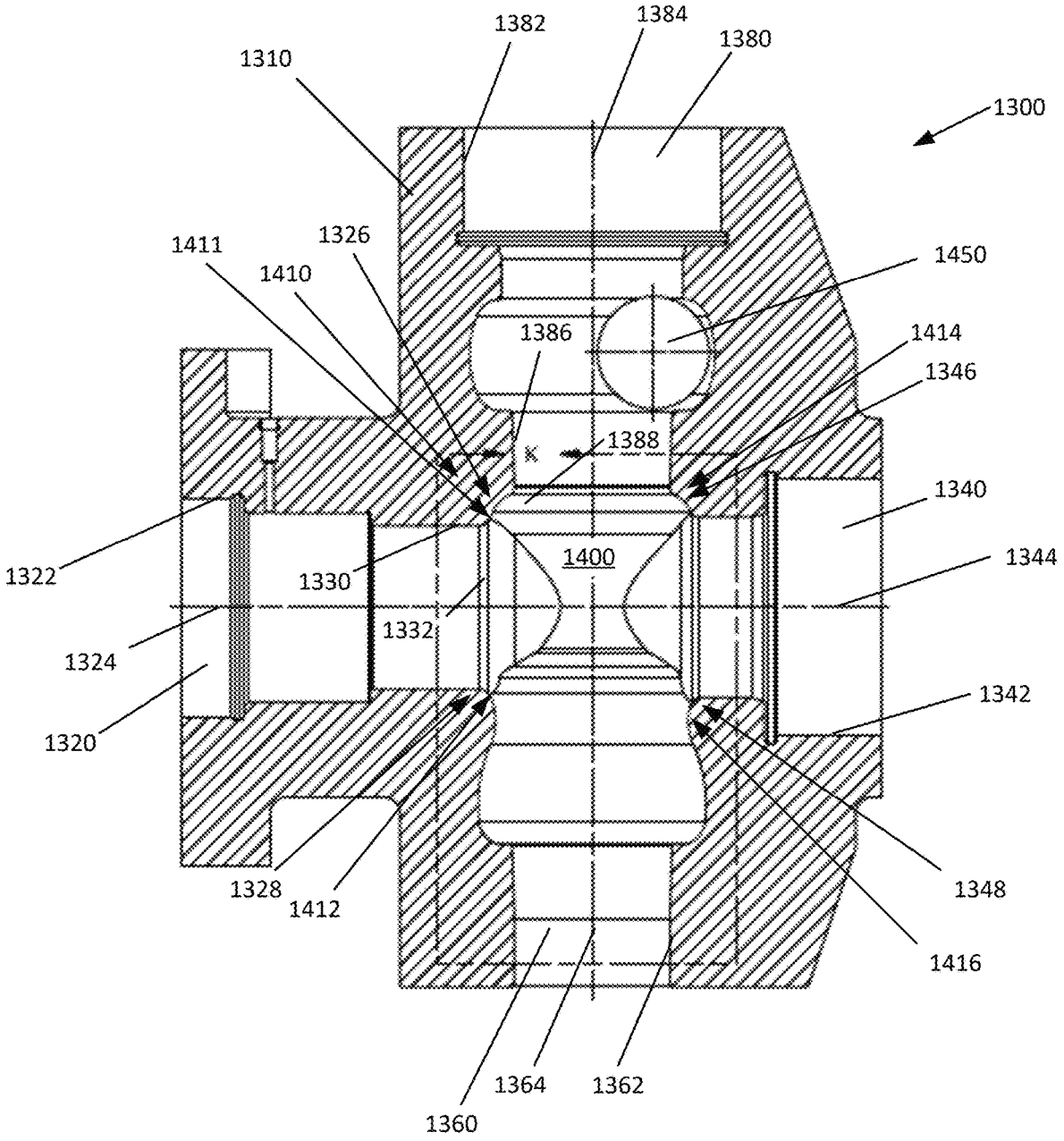
FIG. 13 is a side cross-sectional view of the fluid end illustrated in FIG. 11 taken along line "G-G".
Figure 14:
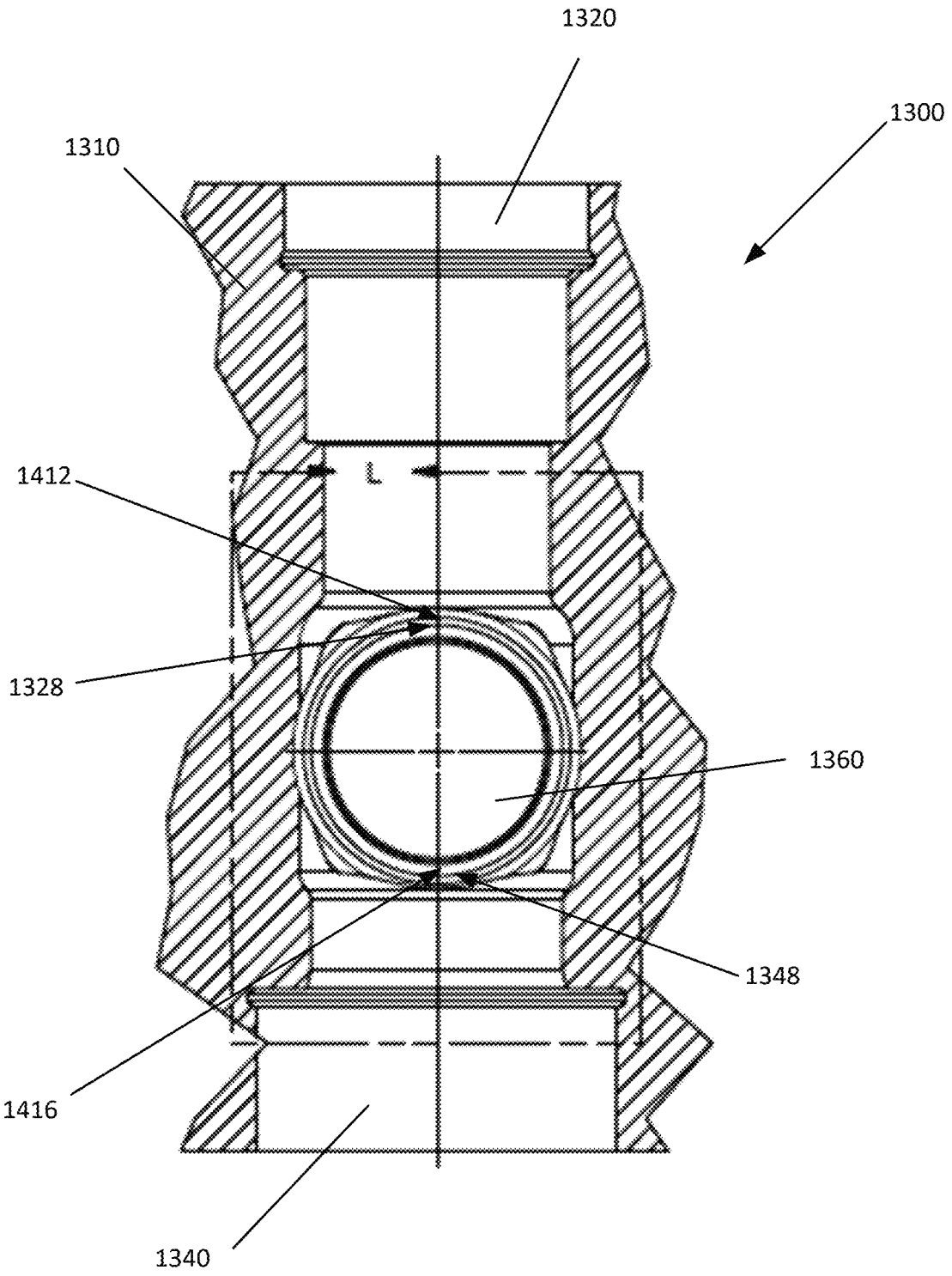
FIG. 14 is a top cross-sectional view of the fluid end illustrated in FIG. 11 taken along line "H-H".
Figure 15:
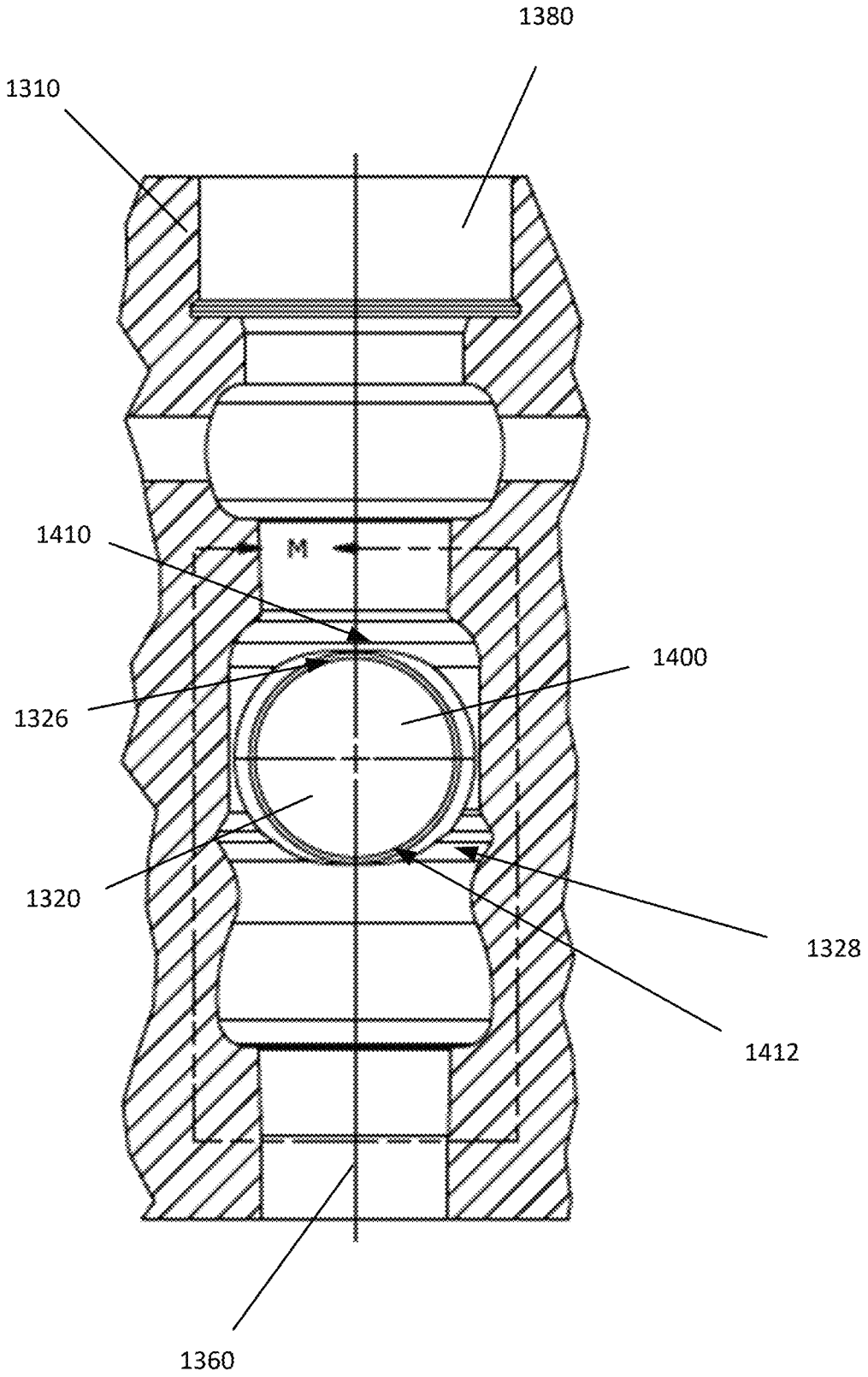
FIG. 15 is a plan cross-sectional view of the fluid end illustrated in FIG. 12 taken along line "J-J".

Each of FIGS. 11 and 12 includes one or more cross-sectional lines that define the views illustrated in subsequent FIGS. Line "G-G" defines the side cross-sectional view illustrated in FIG. 13, line "H-H" defines the top cross-sectional view illustrated in FIG. 14, and line "J-J" defines the plan cross-sectional view illustrated in FIG. 15. Similar cross-sectional views for additional embodiments of pump fluid ends disclosed herein utilize similar cross-sectional lines to those shown in FIGS. 11 and 12.

Referring to FIG. 13, a side cross-sectional view of the fluid end 1300 illustrated in FIG. 11 taken along line "G-G" is illustrated. In this view, the valve components and closure and retaining assemblies have been removed from the fluid end 1300 to facilitate the description thereof. The casing or housing 1310 of fluid end 1300 includes a plunger or power end bore 1320 that is a bore for a reciprocating member, such as a plunger. The plunger bore 1320 has an inner wall or surface 1322 that defines the bore 1320. The plunger bore 1320 also has a plunger axis or centerline 1324 that extends therethrough. The casing 1310 includes a valve cover or access bore 1340 which is defined by an inner surface or surface 1342 and has a centerline or axis 1344. In this embodiment, valve cover bore 1340 does not include a threaded region for the mounting of various fluid end components, but in other embodiments, threads may be formed on inner surface 1342. In this embodiment, centerline 1344 of bore 1340 is aligned with centerline 1324 of bore 1320; but bores 1320 and 1340 need not always be aligned.

The fluid end casing 1310 also includes an inlet bore 1360 that is defined by an inner wall or surface 1362 and has a centerline or axis 1364. The casing 1310 also includes a discharge bore 1380 that is defined by an inner wall or surface 1382 and has a centerline or axis 1384. In this embodiment, the discharge bore 1380 does not include a threaded region for the mounting of various fluid end components, but other embodiments, threads may be formed on inner surface 1382. The discharge bore 1380 is also in fluid communication with a fluid outlet 1450. The centerline 1364 of bore 1360 is aligned with centerline 1384 of bore 1380, but, again, these bores need not always be aligned. The bores 1320, 1340, 1360, and 1380 of the casing 1310 converge to a common intersection, referred to as a cross-bore or cross-bore intersection 1400. The cross-bore intersection 1400 (i.e., the pumping chamber) defines an open space in housing 1310.

As illustrated in FIG. 13, between each pair of intersecting adjacent bores is an intersection corner that has a transition area that includes a surface. Bores 1320 and 1380 are adjacent to each other and intersect, thereby forming a corner or intersection or overlapping corner 1326. Corner 1326 includes a transition area 1410 between the corners of bores 1320 and 1380. Similarly, bores 1320 and 1360 are adjacent to each other and intersect, thereby forming a corner or intersection corner 1328. Corner 1328 includes a transition area 1412 between the corners of bores 1320 and 1360. Often, surfaces located at the intersection of adjacent bores in a fluid end casing experience a high concentration of stresses due to the internal pressure and the particular fluid being pumped. In this embodiment, intersection corners 1326 and 1328 with their respective transition areas 1410 and 1412 are locations at which the concentration of stresses is high during operation of the pump (i.e., the corners bordering plunger bore 1320).

Bores 1340 and 1380 are adjacent to each other and intersect, thereby forming a corner or intersection or overlapping corner 1346. Corner 1346 includes a transition area 1414 between the corners of bores 1340 and 1380. Similarly, bores 1340 and 1360 are adjacent to each other and intersect, thereby forming a corner or intersection corner 1348. Corner 1348 includes a transition area 1416 between the corners of bores 1340 and 1360. Intersection corners 1346 and 1348 are locations at which the concentration of stresses is high during operation of the pump (i.e., the corners bordering suction bore 1340), just like intersection corners 1326 and 1328.

In one embodiment, the inner wall or surface 1322 of bore 1320 includes a first portion 1330 that has a first inner diameter and a second portion 1332 that has a second inner diameter. The second inner diameter is larger than the first inner diameter. The surface 1322 transitions from the first portion 1330 to the second portion 1332. The second portion 1332 includes a curved surface that is defined by a radius.

Similarly, the inner wall or surface 1382 of bore 1380 includes a first portion 1386 that has an inner diameter and a second portion 1388 that has an inner diameter. The inner diameter of the second portion 1388 is larger than the inner diameter of the first portion 1386. In addition, the surface 1382 transitions from first portion 1386 to second portion 1388. The second portion 1388 also includes a curved surface that is defined by a radius. In this embodiment, the curved surface radius of the second portion 1388 of bore 1380 is a different length than the curved surface radius of the second portion 1332 of bore 1320. In addition, surface 1322 and surface 1382 converge with each other at a convex point at the first transition area between bore 1320 and 1380.

To reduce the stresses on the surfaces inside of the fluid end casing, and in particular, on the intersection or overlapping corners between adjacent bores, the present invention relates to machined surfaces located in the transition areas between adjacent bores. If a plane was created using the center axis of the horizontal bores and the vertical bores, the profiles of the horizontal bores and the vertical bores intersect at substantially tangent points. For manufacturability, it is helpful for each intersection point to be a slightly raised point relative to the surrounding surfaces, so the intersection point can be easily hand-finished or easily knocked down with a sanding tool. If an intersection point is sunken relative to the surrounding surfaces, it is challenging to soften the transition between the two intersecting bores.

In the illustrated embodiment, the intersecting point falls on an intersection line that travels along the cross-bore intersection at all points where the vertical bores intersect with the horizontal bores. The intersection points are the locations that experience the highest stress for the cross-bore intersection. By providing a substantially tangent surface, the stress is reduced in those locations. As one moves along each intersecting bore transition line away from a central intersection point, the intersection between the intersecting horizontal and vertical bores become "less tangent" where the stress in the cross-bore is lower. In this embodiment, the upper transition surfaces 1410 and 1414 are formed in a similar manner to the lower transition surfaces 1412 and 1416.

In this embodiment, the transition areas 1410 and 1414 are formed generally similar to each other. Also, transition areas 1412 and 1416 are formed generally similar to each other, but they have a different shape or configuration than transition areas 1410 and 1414, as shown. None of the transition areas 1410, 1412, 1414, or 1416 has a profile that matches a hemisphere or partial sphere profile. In FIG. 13, a slightly raised feature 1411 is formed by the surfaces of adjacent intersecting bore at transition area 1410. Each of the other transition areas 1412, 1414, and 1416 may have a slightly raised feature as well.

FIG. 14 is a top cross-sectional view of the fluid end illustrated in FIG. 11 taken along line "H-H". In FIG. 14, the plunger and access bores 1320 and 1340 in the housing 1310 of fluid end 1300 are illustrated as being aligned with each other and intersecting with bore 360 at bore transition areas 1328 and 1348, which include transition areas 1412 and 1416, respectively. Transition areas 1412 and 1416 are formed on opposite sides of bore 360. Transition area 1412 is located between bores 1320 and 1360, and transition area 1416 is located between bores 1340 and 1360. In this embodiment, fluid end 1300 may include transition features that are similar to transition areas 410 and 414, which are described above relative to FIG. 13.

Referring to FIG. 15, a plan cross-sectional view of the fluid end 320 illustrated in FIG. 12 taken along line "J-J" is illustrated. In this view, bores 1360 and 1380 are oriented vertically and plunger bore 1320 is oriented horizontally. The intersection corner 1326 is shown between bore 1380 and 1320 and is located on the top side of the cross-bore 400. At the lower side of bore 1320, the intersection corner 1328 and transition area 1412 are illustrated between bores 1320 and 1360. In this embodiment, the surface of transition area 1412 of intersection corner 1328 is not shaped along a hemisphere portion. The intersection corner 1328 and transition area 1412 have an intersecting geometry that is not hemispherical.

Figure 16:
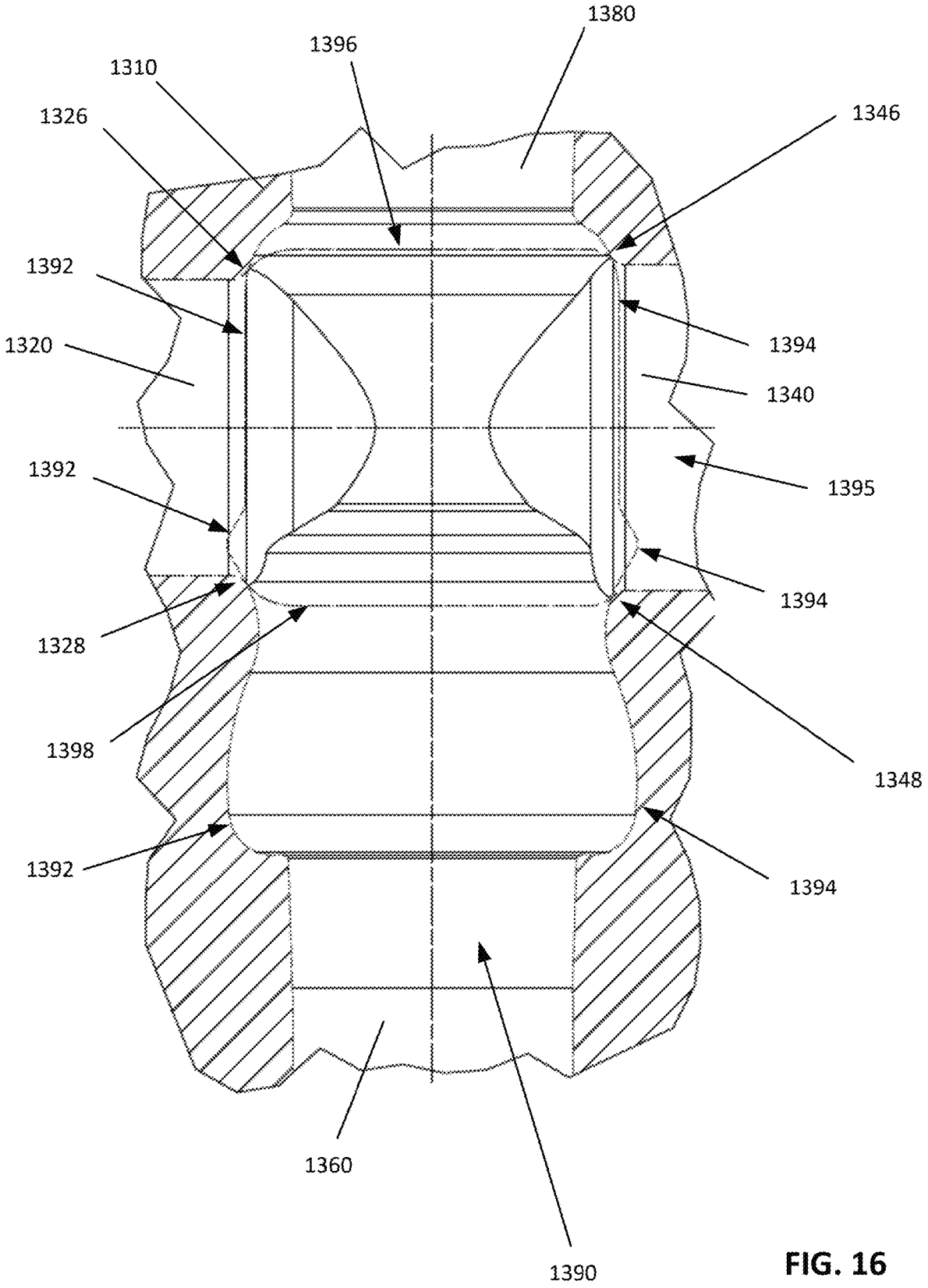
FIG. 16 is a close-up detailed view of the fluid end cross-sectional view illustrated in FIG. 13.

Turning to FIG. 16, a close-up detailed view of a portion of the fluid end casing 1310 illustrated in FIG. 13 is shown. Inlet bore 1360 and discharge bore 1380 collectively define a vertical bore 1390. Vertical bore 1390 is shown in FIG. 16 by dashed line 1392 and dashed line 1394. In this embodiment, dashed line 1392 follows the inner surfaces that form inlet bore 1360 and the inner surfaces that form discharge bore 1380. Dashed line 1392 passes over and defines in part the intersection of plunger bore 1320 and inlet bore 1360, which is shown as bore intersection 1328. In addition, dashed line 1392 passes over and defines in part the intersection of plunger bore 1320 and discharge bore 1380, which is shown as bore intersection 1326.

Dashed line 1394 follows the inner surfaces that form inlet bore 1360 and the inner surfaces that form discharge bore 1380. Dashed line 1394 passes over and defines in part the intersection of access bore 1340 and inlet bore 1360, which is shown as bore intersection 1348. In addition, dashed line 1394 passes over and defines in part the intersection of access bore 1340 and discharge bore 1380, which is shown as bore intersection 1346.

Similarly, plunger bore 1320 and access bore 1340 collectively define a horizontal bore 1395. Horizontal bore 1395 is shown in FIG. 16 by dashed line 1396 and dashed line 1398. In this embodiment, the inner diameter of the plunger bore 1320 is the same as the inner diameter of the access bore 1340.

Dashed line 1396 follows the inner surfaces that form plunger bore 1320 and the inner surfaces that form access bore 1340. Dashed line 1396 passes over and defines in part the intersection of plunger bore 1320 and discharge bore 1380, which is shown as bore intersection 1326. In addition, dashed line 1396 follows the inner surface of the access bore 1340 and passes over and defines in part the intersection of access bore 1340 and discharge bore 1380, which is shown as bore intersection 1346.

Dashed line 1398 follows the inner surfaces that form plunger bore 1320 and the inner surfaces that form access bore 1340. Dashed line 1398 passes over and defines in part the intersection of plunger bore 1320 and inlet bore 1360, which is shown as bore intersection 1328. In addition, dashed line 1398 passes over and defines in part the intersection of access bore 1340 and inlet bore 1360, which is shown as bore intersection 1348.

In this embodiment, the horizontal bore 1395 and the horizontal transition features that are located at transition areas 1326, 1328, 1346, and 1348 are created using radii that transition into coned surfaces. The horizontal bore 1395, as indicated by dashed lines 1396 and 1398, intersects each section of the vertical bore 1390, as indicated by dashed lines 1392 and 1394, at different convex and concave radii.

As mentioned above, the upper bore intersections illustrated in FIG. 16, namely, bore intersection 1326 and bore intersection 1346, are formed with generally the same shape as each other. Each of the upper bore intersections 1326 and 1346 is formed with an intersection point. The lower bore intersections 1328 and 1348 are formed with generally the same shape as each other. As shown in FIG. 16, the profile of the lower bore intersections 1328 and 1348 are different than the upper bore intersections 1326 and 1346. Each of the lower bore intersections 1328 and 1348 are formed with an intersection point or extended portion that can be reduced down during manufacturing. The intersection of vertical bore line 1392 and horizontal bore line 1398 forms a point at bore intersection 1328. Similarly, the intersection of vertical bore line 1394 and horizontal bore line 1398 forms a point at bore intersection 1348.

Figure 17:
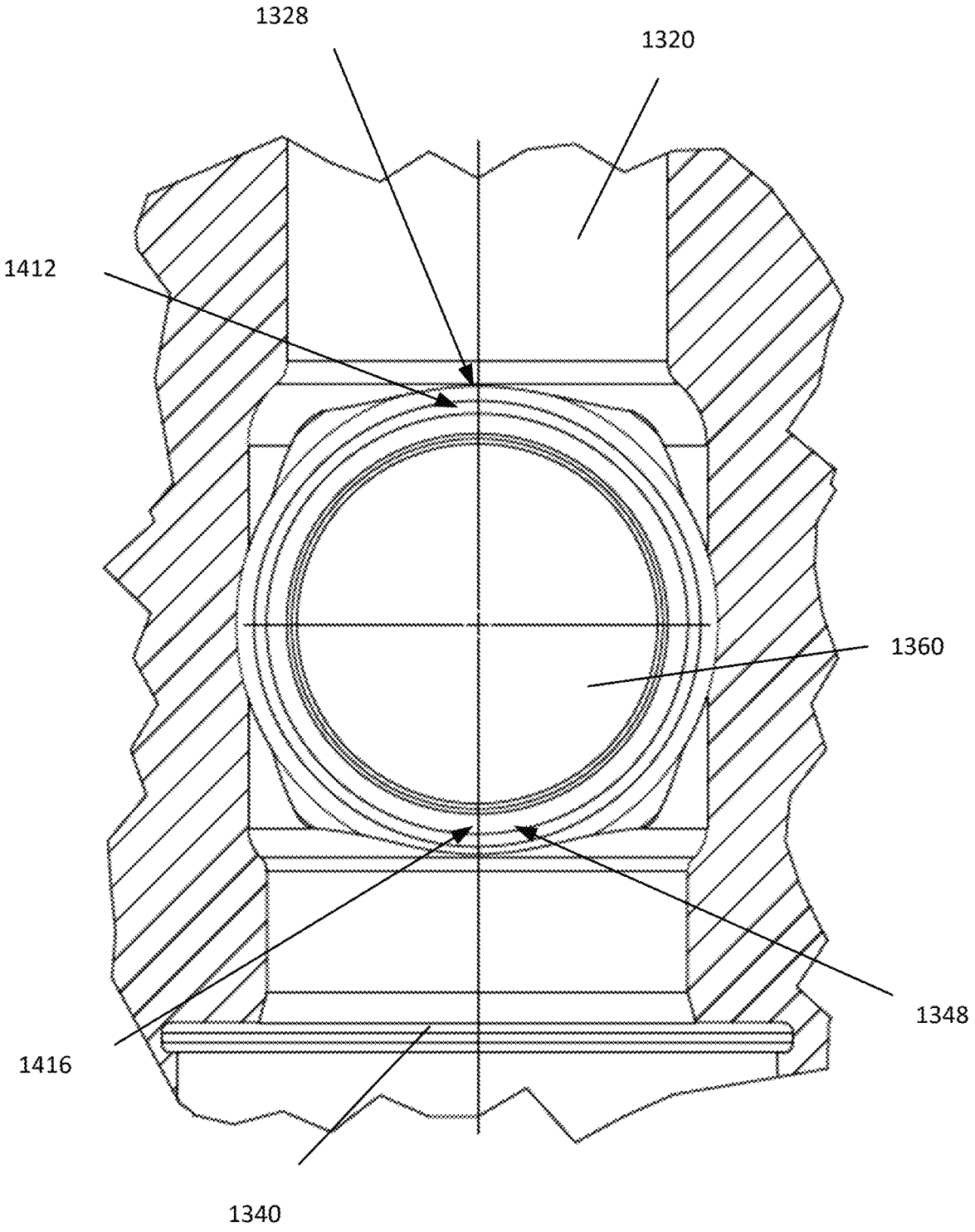
FIG. 17 is a close-up detailed view of the fluid end cross-sectional view illustrated in FIG. 14.

Referring to FIG. 17, a close-up detailed view of the fluid end cross-sectional view illustrated in FIG. 14 is shown. In this view, the complete profile of the horizontal bore is shown. The bore intersection 1328 has a similar structure to bore intersection 1348 because both of them are on the bottom portion of the horizontal bore 1395.

Figure 18:
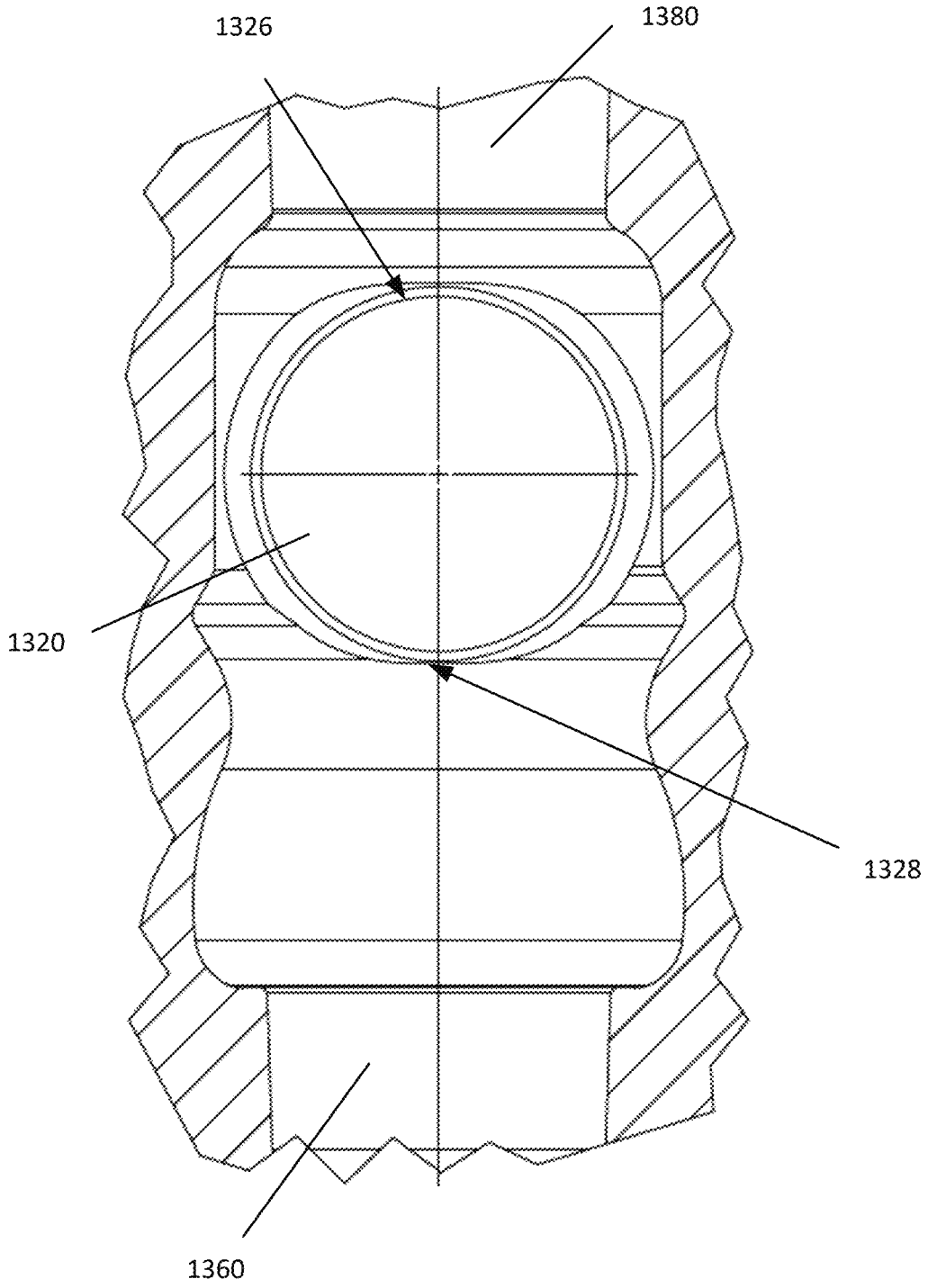
FIG. 18 is a close-up detailed view of the fluid end cross-sectional view illustrated in FIG. 15.

Similarly, referring to FIG. 18, a close-up detailed view of the fluid end cross-sectional view illustrated in FIG. 15 is shown. In this view, the complete profile of the vertical bore is shown. The bore intersection 1326 and its transition area 1410 are located on the upper side or portion of the horizontal bore 1395, which is aligned with plunger bore 1320 in FIG. 18. The bore intersection 1328 and its transition area 1412 are located on the lower side or portion of the horizontal bore 1395. In this embodiment, bore intersection 1326 and bore intersection 1328 are similar to other.

Turning to a method of manufacturing a fluid end of a reciprocating pump, an exemplary method includes a few steps. Once the fluid end housing is formed, a first bore is machined in the housing. In one embodiment, the first bore is formed so that it has an inner surface that transitions from a first portion with a first inner diameter to a second portion with a second inner diameter. The second inner diameter is larger than the first inner diameter.

Next, a second bore is machined in the housing. Similar to the first bore, the second bore is formed with an inner surface that transitions from a third portion with a third inner diameter to a fourth portion with a fourth inner diameter, and the fourth inner diameter is larger than the third inner diameter. When the first bore and the second bore are machined, the fourth portion of the second inner surface intersects with the second portion of the first inner surface at a first intersection corner. At that first intersection corner, the fourth portion and the second portion collectively form a slightly raised feature. In one embodiment of the invention, approximately 90% of the manufacturing steps for forming the first bore and the second bore is accomplished via machining processes.

The remaining polishing to reduce raised points at the intersections of adjacent bores is accomplished by hand finishing. In one embodiment of a manufacturing process according to the present invention, an operator reaches through a third bore to hand-finish an intersecting corner between other adjacent, intersecting bores. In another embodiment of a manufacturing process according to the present invention, an intersection area to be hand-finished is accessed by reaching through one of the adjacent, intersecting bores.

In one embodiment, the process of machining the first bore in the housing includes forming a first inner surface that is defined by a first radius. Similarly, the process of machining the second bore in the housing includes forming a second inner surface defined by a second radius. In one embodiment, the second radius is a different length than the first radius. Also, the first inner surface and the second inner surface converge with each other at a convex point at the first transition area. In addition, the second radius intersects the first radius.

In operation, each plunger reciprocates along the corresponding centerline or axis of each plunger bore. As each plunger reciprocates along the plunger bore axis, away from the valve cover bore, fluid is drawn into each inlet bore through the fluid inlet. Subsequently, the fluid passes into cross-bore intersections along the inlet axes. At this point, each plunger reciprocates along the plunger bore axis, toward the valve cover bore, which causes the fluid to exit the fluid end of the pump through each discharge bore along axis. Specifically, the fluid exits through the fluid outlet disposed within a discharge bore. Each plunger continuously reciprocates along the plunger axes to draw fluid into the fluid end and to eject the fluid from the fluid end.

Thus, the invention provides interior surfaces for bores having a geometry to reduce stresses on the fluid of a pump caused by fluidic pressures. The invention minimizes operating stresses in the lower quadrant (or hemisphere) of the cross-bore intersection. The invention improves the fatigue life of the fluid end of the pump. The hemispherical transition surfaces tend to reduce the stress concentration at the cross-bore intersection by smoothing the geometry of the inlet bore and improving the distribution of the load around the cross-bore intersection.

It is to be understood that the invention as described herein can apply to any fluid end block that has at least two intersecting bores. In one embodiment, one of the intersecting bores includes a hemisphere profile for its surfaces, and the other of the two bores include a stepped transition feature.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. For example, a retaining ring or any other component of a retaining assembly shown with one embodiment of a closure element can be used with any desirable closure element to forma closure assembly of the present application. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A fluid end of a reciprocating pump, the fluid end comprising:

a housing defining:

a first bore with a first inner surface that transitions from a first portion with a first inner diameter to a second portion with a second inner diameter, the second inner diameter being larger than the first inner diameter, the first bore having a first centerline;

a second bore having a second inner surface that transitions from a third portion with a third inner diameter to a fourth portion with a fourth inner diameter, the fourth inner diameter being larger than the third inner diameter, the second bore intersecting with the first bore at a first intersection corner, the second bore having a second centerline;

a third bore intersecting with the second bore at a second intersection corner; the third bore having a third inner surface, the third bore having a third centerline, the third centerline being colinear with the first centerline; and a first intersection line with a first portion that extends along the first inner surface of the first bore and a second portion that extends along the third inner surface of the third bore, the first portion of the first intersection line and the second portion of the first intersection line are offset from each other, the first portion of the first intersection line terminates at the second centerline and the second portion of the first intersection line terminates at the second centerline at a location offset from where the first portion of the first intersection line terminates at the second centerline, wherein the first intersection corner defines a first transition area having a first transition surface where the second portion of the first inner surface and the fourth portion of the second inner surface intersect to form a raised feature, and the first transition surface is a machinable transition feature that overlaps both of the first bore and the second bore.

2. The fluid end of claim 1, wherein the housing further comprises:

a fourth bore intersecting with the third bore at a third intersection corner defining a third transition area, the fourth bore also intersects with the first bore at a fourth intersection corner, each of the first bore, the second bore, the third bore, and the fourth bore is in fluid communication with a cross-bore, the fourth intersection corner defines a fourth transition area having a fourth transition surface, and the fourth transition surface is a machinable transition feature that overlaps both of the first bore and the fourth bore.

3. The fluid end of claim 2, wherein the third transition area is a substantially tangent point in profile.

4. The fluid end of claim 2, wherein each of the third transition area and the fourth transition area is a substantially tangent point in profile.

5. The fluid end of claim 2, wherein the housing has a second intersection line with a third portion that extends along the first inner surface of the first bore and a fourth portion that extends along the third inner surface of the third bore, a third intersection line with a fifth portion that extends along the second inner surface of the second bore and a sixth portion that extends along a fourth inner surface of the fourth bore, and a fourth intersection line with a seventh portion that extends along the second inner surface of the second bore and an eighth portion that extends along the fourth inner surface of the fourth bore.

6. The fluid end of claim 5, wherein the first portion of the first intersection line and the fifth portion of the third intersection line intersect at the first intersection corner, and the third portion of the second intersection line and the sixth portion of the third intersection line intersect at the fourth intersection corner.

7. The fluid end of claim 6, wherein the first intersection corner has a different profile than the fourth intersection corner.

8. The fluid end of claim 6, wherein the second portion of the first intersection line and the seventh portion of the fourth intersection line intersect at the second intersection corner, the fourth portion of the second intersection line and the eighth portion of the fourth intersection line intersect at the third intersection corner, and the second intersection corner has a different profile than the third intersection corner.

9. The fluid end of claim 8, wherein the first intersection corner and the second intersection corner have similar profiles, and the third intersection corner and the fourth intersection corner have similar profiles that are different than profiles of the first intersection corner and the second intersection corner.

10. The fluid end of claim 8, wherein the first bore and the third bore collectively form a horizontal bore, and the horizontal bore intersects each of the second bore and the fourth bore at a surface with a radius than is different that the horizontal bore's intersection with the other of the second bore and the fourth bore.

11. The fluid end of claim 8, wherein each of the first intersection corner matches a hemisphere profile, the second intersection corner matches a hemisphere profile, and each of the third intersection corner and the fourth intersection corner has a profile that is a substantially tangent point instead of a hemisphere profile.

12. The fluid end of claim 5, wherein the third bore has its own inner diameter, and the inner diameter of the third bore is greater than the second inner diameter of the first bore.

13. The fluid end of claim 12, wherein the third portion of the second intersection line and the fourth portion of the second intersection line are offset from each other.

14. The fluid end of claim 1, wherein the intersection of the first portion with the second centerline being offset from the intersection of the second portion with the second centerline results in a stepped feature.

15. A fluid end of a reciprocating pump, the fluid end comprising:

a housing defining:

a first bore having a first portion with a first inner surface defining a first inner diameter and a second portion with a second inner surface defining a second inner diameter, the second inner surface defined by a first radius, the first portion transitions to the second portion, and the second inner diameter is larger than the first inner diameter, the first bore having a first centerline;

a second bore being oriented substantially perpendicularly relative to the first bore, the second bore having its own inner surface defined by a second radius different from the first radius, the second bore intersecting with the first bore at a first intersection corner located in a cross-bore of the housing, the second bore has a third portion with a third inner diameter and a fourth portion with a fourth inner diameter, the third portion transitions to the fourth portion, and the fourth inner diameter is larger than the third inner diameter, the fourth portion of the second bore and the second portion of the first bore intersecting at the first intersection corner, the second bore having a second centerline;

a third bore intersecting with the second bore at a second intersection corner; the third bore having a third inner surface, the third bore having a third centerline, the third centerline being colinear with the first centerline; and a first intersection line with a first portion that extends along the second inner surface of the first bore and a second portion that extends along the third inner surface of the third bore, the first portion of the first intersection line and the second portion of the first intersection line are offset from each other, the first portion of the first intersection line terminates at the second centerline at a first point and the second portion of the first intersection line terminating at the second centerline at a second point, the second point being offset from the first point, wherein the first intersection corner defines a first transition area having a first transition surface that is a machinable transition feature that overlaps both of the first bore and the second bore, and the second inner surface of the first bore and the inner surface of the second bore converge with each other at a convex point at the first transition area.

16. The fluid end of claim 15, wherein the housing further comprises:

a fourth bore intersecting with the third bore at a third intersection corner, the fourth bore also intersects with the first bore at a fourth intersection corner, wherein each of the first bore, the second bore, the third bore, and the fourth bore is in fluid communication with the cross-bore, the fourth intersection corner defines a fourth transition area having a fourth transition surface, and the fourth transition surface is a machinable transition feature that overlaps both of the first bore and the fourth bore.

17. The fluid end of claim 15, wherein the first point being offset from the second point results in a stepped feature.

18. A method of manufacturing a fluid end of a reciprocating pump, the fluid end including a housing, the method comprising the steps of:

machining a first bore in the housing, the first bore having a first inner surface that transitions from a first portion with a first inner diameter to a second portion with a second inner diameter, the second inner diameter being larger than the first inner diameter, the first bore having a first centerline;

machining a second bore in the housing, the second bore having a second inner surface that transitions from a third portion with a third inner diameter to a fourth portion with a fourth inner diameter, the fourth inner diameter being larger than the third inner diameter, the fourth portion of the second inner surface intersecting with the second portion of the first inner surface at a first intersection corner and collectively forming a raised feature, the second bore having a second centerline;

machining a third bore in the housing, the third bore intersecting with the second bore at a second intersection corner, the third bore having a third inner surface, the third bore having a third centerline, the third centerline being colinear with the first centerline; and hand finishing the raised feature by accessing the first intersection corner through a bore of the fluid end, wherein the steps of machining the first bore in the housing and machining the third bore in the housing form a first intersection line with a first portion that extends along the first inner surface of the first bore and a second portion that extends along the third inner surface of the third bore, the first portion of the first intersection line and the second portion of the first intersection line are offset from each other, the first portion of the first intersection line terminating at the second centerline at a first point and the second portion of the first intersection line terminating at the second centerline at a second point, the second point being offset from the first point.

19. The method of claim 18, wherein:

the step of machining the first bore in the housing includes forming a first inner surface defined by a first radius; and the step of machining the second bore in the housing includes forming a second inner surface defined by a second radius, wherein the second radius is different from the first radius, and the first inner surface and the second inner surface converge with each other at a concave point at the first intersection corner.

20. The method of claim 19, wherein the second radius intersects the first radius.

* * * * *